US010436045B2

(12) United States Patent
Honda

(10) Patent No.: US 10,436,045 B2
(45) Date of Patent: Oct. 8, 2019

(54) SUPPORT DEVICE, TURBINE, AND SUPPORT METHOD

(71) Applicant: MITSUBISHI HITACHI POWER SYSTEMS, LTD., Kanagawa (JP)

(72) Inventor: Shinya Honda, Kanagawa (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 525 days.

(21) Appl. No.: 15/121,984

(22) PCT Filed: Mar. 2, 2015

(86) PCT No.: PCT/JP2015/056043
§ 371 (c)(1),
(2) Date: Aug. 26, 2016

(87) PCT Pub. No.: WO2015/133421
PCT Pub. Date: Sep. 11, 2015

(65) Prior Publication Data

US 2017/0074109 A1 Mar. 16, 2017

(30) Foreign Application Priority Data

Mar. 6, 2014 (JP) ..... 2014-044396

(51) Int. Cl.
*F01D 25/24* (2006.01)
*F01D 9/04* (2006.01)
(Continued)

(52) U.S. Cl.
CPC ..... *F01D 9/042* (2013.01); *F01D 5/025* (2013.01); *F01D 5/30* (2013.01); *F01D 25/24* (2013.01);
(Continued)

(58) Field of Classification Search
CPC ..... F01D 25/246; F01D 25/265; F01D 25/28; F01D 25/26
See application file for complete search history.

(56) References Cited

U.S. PATENT DOCUMENTS 1,352,278 A * 9/1920 Junggren ..... F01D 25/26 415/135
3,544,233 A * 12/1970 Brown ..... F01D 9/06 415/126
(Continued)

FOREIGN PATENT DOCUMENTS

JP 2002-115502 4/2002
JP 2007-154886 6/2007
(Continued)

OTHER PUBLICATIONS

Decision of a Patent Grant dated Feb. 28, 2017 in corresponding Japanese Application No. 2016-506474 (with English translation).
(Continued)

*Primary Examiner* — Carlos A Rivera
*Assistant Examiner* — Behnoush Haghighian
(74) *Attorney, Agent, or Firm* — Wenderoth, Lind & Ponack, L.L.P.

(57) ABSTRACT

A support device supports an inner member of a fixed body including the inner member and an outer member, the inner member being arranged around a rotating body and divided into upper and lower sections and the outer member being arranged in at least a part around the inner member and divided into upper and lower sections. The support device includes a first member including a main body portion arranged in a recessed portion provided in the outer member, and adapted to support the inner member, and a second member including a handle portion arranged in a space between a side surface of the main body portion and an inner wall surface of the recessed portion, the inner wall surface
(Continued)

being positioned in at least a part around the side surface, and a first adjustment unit arranged in a gap between a lower surface of the main body portion and a bottom surface of the recessed portion, the bottom surface being positioned below the lower surface, through the space, the second member being adapted to adjust a position of the first member.

10 Claims, 16 Drawing Sheets

(51) Int. Cl.
*F01D 25/28* (2006.01)
*F01D 5/02* (2006.01)
*F01D 5/30* (2006.01)
*F01D 25/26* (2006.01)

(52) U.S. Cl.
CPC ..... *F01D 25/243* (2013.01); *F01D 25/246* (2013.01); *F01D 25/28* (2013.01); *F01D 25/26* (2013.01); *F01D 25/265* (2013.01); *F01D 25/285* (2013.01); *F05D 2240/90* (2013.01)

(56) References Cited

U.S. PATENT DOCUMENTS 3,861,827 A * 1/1975 Peabody ..... F01D 25/246 415/199.5
5,709,388 A * 1/1998 Skinner ..... F01D 11/025 277/412
6,352,405 B1 * 3/2002 Tomko ..... F01D 25/246 415/209.2
6,695,316 B2 * 2/2004 Popa ..... F16J 15/442 277/411
7,329,098 B2 * 2/2008 Burdgick ..... F01D 25/246 415/213.1
9,500,130 B2 * 11/2016 Swan ..... F02C 7/20
2006/0251514 A1 11/2006 Burdgick
2007/0119174 A1 5/2007 Russo et al.
2008/0286097 A1 * 11/2008 Chevrette ..... F01D 25/246 415/209.2
2011/0116919 A1 5/2011 Burdgick et al.
2011/0305566 A1 12/2011 Sankolli et al.
2013/0323026 A1 12/2013 Abbott et al.

FOREIGN PATENT DOCUMENTS

JP 2008-286195 11/2008
JP 2011-106452 6/2011
JP 2011-256866 12/2011
JP 2012-137035 7/2012

OTHER PUBLICATIONS

Written Opinion of the International Searching Authority dated May 26, 2015 in International (PCT) Application No. PCT/JP2015/056043, with English translation.
International Search Report dated May 26, 2015 in International (PCT) Application No. PCT/JP2015/056043.

* cited by examiner

SUPPORT DEVICE, TURBINE, AND SUPPORT METHOD

FIELD

The present invention relates to a support device, a turbine, and a support method.

BACKGROUND

A turbine includes a rotating body and a fixed body arranged around the rotating body. The rotating body includes a rotor including blades. The fixed body includes an inner member like a blade ring that supports vanes, and an outer member like a casing arranged around the inner member. The blade ring is supported by a support device. The support device adjusts the position of the blade ring. An example of a technology regarding a support device that can adjust the position in a vertical direction for a diaphragm segment in a turbine casing is disclosed in Patent Literature 1.

CITATION LIST

Patent Literature

Patent Literature 1: JP 2008-286195 A

SUMMARY

Technical Problem

When the position of the blade ring is adjusted by the support device, the positional relationship (the dimension of a gap) between the rotor and the blade ring is adjusted. The adjustment work of the position of the blade ring is performed in a state where an operation of the turbine is stopped. Therefore, if the adjustment work is not smoothly performed, a decrease in an operation rate of the turbine is caused.

An objective of the present invention is to provide a support device and a support method that enable smooth adjustment work of the position of an inner member of a fixed body. Further, an objective of the present invention is to provide a turbine that can suppress a decrease in an operation rate.

Solution to Problem

In accordance with a first aspect of the present invention, there is provided a support device that supports an inner member of a fixed body including the inner member and an outer member, the inner member being arranged around a rotating body and divided into upper and lower sections, and the outer member being arranged in at least a part around the inner member and divided into upper and lower sections, the support device comprising:

a first member having a main body portion arranged in a recessed portion provided in the outer member, and adapted to support the inner member; and a second member including a handle portion arranged in a space between a side surface of the main body portion and an inner wall surface of the recessed portion, the inner wall surface being positioned in at least a part around the side surface, and a first adjustment unit arranged in a gap between a lower surface of the main body portion and a bottom surface of the recessed portion, the bottom surface being positioned below the lower surface, through the space, the second member being adapted to adjust a position of the first member.

According to the first aspect of the present invention, the position of the support member in a vertical direction can be adjusted by the second member having the first adjustment unit. The second member can be smoothly moved with the handle portion, and replacement of the second member can be smoothly performed. The second member can be smoothly replaced through the space between the side surface of the main body portion and the inner wall surface of the recessed portion. The inner member and the outer member can be divided into upper and lower sections. By dividing the inner member and the outer member, replacement of the second member can be smoothly performed, and adjustment work of the position of the inner member of the fixed body can be smoothly performed.

In the first aspect of the present invention, the first adjustment unit may include a detachable lower liner. Therefore, the thickness of the first adjustment unit can be easily adjusted by simply replacing the lower liner.

In the first aspect of the present invention, the space may be formed in at least one of one side and the other side of the main body portion in an axial direction along a rotational axis of the rotating body. Therefore, the first adjustment unit is moved in the axial direction, so that a state where the first adjustment unit is arranged in the gap and a state where the first adjustment unit is arranged outside the gap can be changed from one to the other. Accordingly, the second member can be replaced without providing a space in the radial direction with respect to the rotational axis of the rotating body. Therefore, a dimension of the outer member in the radial direction with respect to the rotational axis can be made small.

In the first aspect of the present invention, the space may include a first partial space where the handle portion is arranged, and a second partial space where the first adjustment unit passes through. Therefore, the first partial space and the second partial space are divided, and thus an increase in a size of one of the first partial space and the second partial space can be suppressed.

In the first aspect of the present invention, one partial space of the first partial space and the second partial space may be provided in an axial direction along a rotational axis of the rotating body with respect to the main body portion, and the other partial space may be provided in a radial direction with respect to the rotational axis with respect to the main body portion. Therefore, an increase in sizes of the first partial space and the second partial space can be suppressed.

In the first aspect of the present invention, the support device may further comprise a third member adapted to regulate movement of the second member, wherein the third member may include a fixed portion detachably fixed to the outer member, a spacer portion arranged in the space in a state where the fixed portion is fixed to the outer member, and a second adjustment unit arranged above the main body portion. Therefore, displacement of the inner member can be suppressed.

In the first aspect of the present invention, the second adjustment unit may include a detachable upper liner. Therefore, the thickness of the second adjustment unit can be easily adjusted by simply replacing the upper liner. In a case where the thickness of the first adjustment unit has been changed, the thickness of the second adjustment unit is changed based on the thickness of the first adjustment unit such that the dimension of the gap between the first adjustment unit and the second adjustment unit is maintained constant, whereby the main body portion can be smoothly kept arranged between the first adjustment unit and the second adjustment unit before and after the change of the thickness of the first adjustment unit.

In the first aspect of the present invention, the handle portion and at least a part of the first adjustment unit may be integrally formed. Therefore, it is not necessary to manufacture a plurality of members.

In accordance with a second aspect of the present invention, there is provided a turbine comprising:

the support device according to the first aspect;

a blade ring supported by the support device; and a casing arranged around the blade ring.

According to the second aspect of the present invention, adjustment work of the position of the inner member is smoothly performed, and thus a decrease in an operation rate can be suppressed.

In accordance with a third aspect of the present invention, there is provided a support method of supporting an inner member of a fixed body including the inner member and an outer member, the inner member being arranged around a rotating body and divided into upper and lower sections and the outer member being arranged in at least a part around the inner member and divided into upper and lower sections, the support method using a support device including a first member including a main body portion arranged in a recessed portion provided in the outer member, and adapted to support the inner member, and a second member including a handle portion arranged in a space between a side surface of the main body portion and an inner wall surface of the recessed portion, the inner wall surface being positioned in at least a part around the side surface, and a first adjustment unit arranged in a gap between a lower surface of the main body portion and a bottom surface of the recessed portion, the bottom surface being positioned below the lower surface, and able to pass through the space, the second member being adapted to adjust a position of the first member, the support method comprising:

operating the handle portion arranged in the space to move the second member such that the first adjustment unit arranged in the gap is moved outside the gap;

moving the second member such that the first adjustment unit moved outside the gap passes through the space, and detaching the second member from the recessed portion;

adjusting a thickness of the first adjustment unit;

moving the second member so as to be arranged in the gap after the first adjustment unit with an adjusted thickness passes through the space, and attaching the second member to the recessed portion; and supporting the inner member with the first adjustment unit arranged in the gap and the first member.

According to the third aspect of the present invention, by moving the second member such that one state where the first adjustment unit is arranged in the gap is changed to the other state where the first adjustment unit is arranged outside the gap, replacement of the second member can be smoothly performed. The second member can be smoothly moved with the handle portion. The second member can be smoothly replaced through the space between the side surface of the main body portion and the inner wall surface of the recessed portion. The inner member and the outer member can be divided into upper and lower sections. By dividing the inner member and the outer member, replacement of the second member can be smoothly performed. The replacement of the second member is performed after disassembly of the fixed body. The disassembly of the fixed body includes detachment of an upper half portion of the outer member from a lower half portion of the outer member, and detachment of an upper half portion of the inner member from a lower half portion of the inner member. After the upper half portion of the inner member is detached from the lower half portion of the inner member, the replacement of the second member can be performed without detaching the rotating body. After the second member is replaced, the fixed body is assembled. The assembly of the fixed body includes joining of the upper half portion of the inner member and the lower half portion of the inner member, and joining of the upper half portion of the outer member and the lower half portion of the outer member. As described above, replacement of the second member can be smoothly performed without detaching the rotating body, and thus adjustment work of the position of the inner member of the fixed body can be smoothly performed.

In the third aspect of the present invention, the support method may use the support device further including a third member adapted to regulate movement of the second member, the third member including a fixed portion detachably fixed to the outer member, a spacer portion arranged in the space in a state where the fixed portion is fixed to the outer member, and a second adjustment unit arranged above the main body portion, the support method comprising:

cancelling fixation of the third member, and detaching the third member from the outer member; and moving the second member such that the first adjustment unit passes through the space where the spacer portion has been arranged. Therefore, displacement of the inner member is suppressed.

In the third aspect of the present invention, the handle portion may be arranged outside the main body portion in a radial direction with respect to a rotational axis of the rotating body in a state where the first adjustment unit is arranged in the gap.

Therefore, the dimension of the second member in the axial direction can be made small.

Advantageous Effects of Invention

According to the support device and the support method according to the present invention, adjustment work of the position of an inner member of a fixed body can be smoothly performed. Further, according to the turbine of the present invention, a decrease in an operation rate can be suppressed.

DESCRIPTION OF EMBODIMENTS

Hereinafter, embodiments according to the present invention will be described with reference to the drawings. However, the present invention is not limited to the embodiments. Elements of the embodiments described below can be appropriately combined. Further, there is a case where a part of the constituent elements is not used. Further, the constituent elements in the embodiments include those easily replaced by a person skilled in the part and those substantially the same.

In the description below, an XYZ rectangular coordinate system is set, and positional relationships among portions will be described with reference to the XYZ rectangular coordinate system. One direction in a horizontal plane is an X axis direction, a direction perpendicular to the X axis direction in the horizontal plane is a Y axis direction, and a direction perpendicular to both of the X axis direction and the Y axis direction (that is, the direction is a vertical direction) is a Z axis direction. Further, rotational (inclined) directions around the X, Y, and Z axes are θX, θY, and θZ directions, respectively. An XY plane is parallel to the horizontal plane. A +Z direction is an up direction (upward). A −Z direction is a down direction (downward).

First Embodiment

Figure 1:
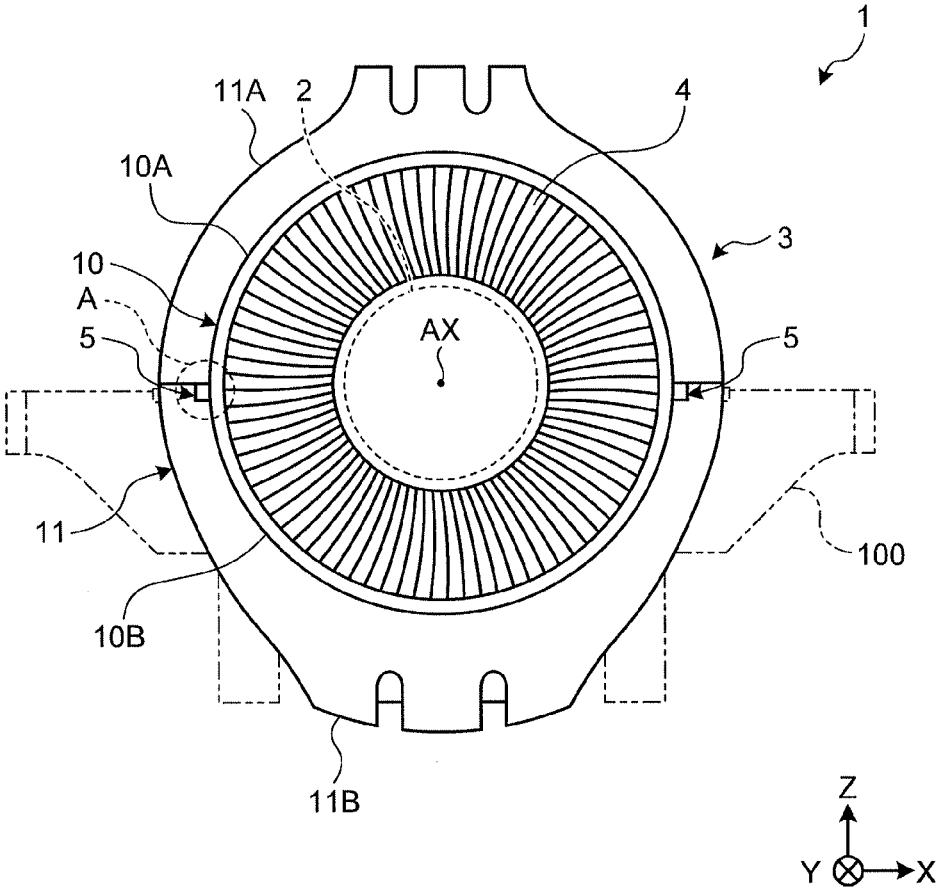
FIG. 1 is a sectional view illustrating an example of a steam turbine according to a first embodiment.

A first embodiment will be described. FIG. 1 is a sectional view illustrating an example of a turbine 1 according to the present embodiment. In the present embodiment, the turbine 1 is a steam turbine. In the description below, the turbine 1 is referred to as steam turbine 1. Note that the turbine 1 may be a gas turbine.

As illustrated in FIG. 1, the steam turbine 1 includes a rotating body 2, and a fixed body 3 arranged around the rotating body 2. The steam turbine 1 is used in a power generation plant, for example.

The rotating body 2 includes a rotor having blades. The rotor (rotating body) 2 has a rotatable rotor shaft. The blades are supported by the rotor shaft. The rotor 2 is rotated around a rotational axis AX. In the present embodiment, the rotational axis AX is parallel to the Y axis. In the description below, the Y axis direction parallel to the rotational axis AX is appropriately referred to as axial direction. Further, a rotational direction around the rotational axis AX is appropriately referred to as circumferential direction. Further, a radial direction with respect to the rotational axis AX is appropriately referred to as radius direction. Note that the Y axis direction (axial direction) may just be a direction along the rotational axis AX, and may not be completely parallel to the rotational axis AX. A +Y direction is one direction along the rotational axis AX. A −Y direction is an opposite direction to the +Y direction. The radial direction includes the horizontal direction. A +X direction is one direction regarding the radial direction parallel to the horizontal plane. A −X direction is an opposite direction to the +X direction.

The fixed body 3 includes a stator that substantially stands still. The fixed body 3 is arranged around the rotating body 2, and includes a blade ring 10 that supports vanes 4, and a casing 11 arranged in at least a part around the blade ring 10. The casing 11 is an outer member arranged outside the blade ring 10 with respect to the rotational axis AX. The blade ring 10 is an inner member arranged inside the casing 11.

The casing 11 houses the rotor 2 and the blade ring 10. The casing 11 is supported by a frame 100. The frame 100 is arranged on a support surface such as a floor surface of a power generation plant. The rotor 2 and the blade ring 10 are arranged in an inner space of the casing 11. The blade ring 10 has a ring shape in an XZ plane perpendicular to the rotational axis AX. The casing 11 is arranged around the blade ring 10.

A plurality of the vanes 4 is arranged in the axial direction and in the circumferential direction on an inner surface of the blade ring 10. The blade (not illustrated) is arranged between the vane 4 and the vane 4.

The fixed body 3 is divided into upper and lower sections. That is, the blade ring 10 is divided into upper and lower sections, and the casing 11 is divided into upper and lower sections. In the description below, an upper portion of the fixed body 3 divided into upper and lower sections is appropriately referred to as upper half portion, and a lower portion is appropriately referred to as lower half portion. That is, the blade ring 10 is divided into an upper half portion 10A and a lower half portion 10B. The casing 11 is divided into an upper half portion 11A and a lower half portion 11B. In assembly of the steam turbine 1, the upper half portion and the lower half portion of the fixed body 3 are joined. In disassembly of the steam turbine 1, the upper half portion of the fixed body 3 is detached from the lower half portion.

The disassembly of the steam turbine 1 is performed from disassembly of the outer member. That is, after the upper half portion 11A of the casing 11 is detached from the lower half portion 11B of the casing 11, the upper half portion 10A of the blade ring 10 is detached from the lower half portion 10B of the blade ring 10.

The assembly of the steam turbine 1 is performed from assembly of the inner member. That is, after the upper half portion 10A of the blade ring 10 and the lower half portion 10B of the blade ring 10 are joined, the upper half portion 11A of the casing 11 and the lower half portion 11B of the casing 11 are joined.

The steam turbine 1 includes a support device 5 that supports the blade ring 10. At least a part of the support device 5 is supported by the casing 11. The blade ring 10 is supported by the support device 5 provided in the casing 11.

The support device 5 can adjust the position of the blade ring 10. In the present embodiment, the support device 5 can adjust the position of the blade ring 10 in the Z axis direction (vertical direction). In the present embodiment, the support device 5 supports the lower half portion 10B of the blade ring 10. The support device 5 adjusts the position of the lower half portion 10B, thereby to adjust the position of the blade ring 10 including both of the upper half portion 10A and the lower half portion 10B.

A plurality of the support devices 5 is provided. The plurality of support devices 5 supports a plurality of different portions of the blade ring 10 in the circumferential direction, the radius direction, and the axial direction. When the plurality of support devices 5 adjusts the position of the blade ring 10, not only the position of the blade ring 10 in the vertical direction, but also the position of the blade ring 10 in the circumferential direction and the radius direction is adjusted.

When the position of the blade ring 10 is adjusted by the support devices 5, the positional relationship between the rotor 2 and the blade ring 10 is adjusted. When the position of the blade ring 10 is adjusted, a dimension of a gap between the rotor 2 and the blade ring 10 is adjusted. The gap between the rotor 2 and the blade ring 10 is adjusted to have an expected dimension by the support devices 5 such that the rotor 2 and the blade ring 10 are not in contact, and that a decrease in thermal efficiency is suppressed. The gap between the rotor 2 and the blade ring 10 includes a gap between a tip end of the blade of the rotor 2 and an inner surface of a sealing ring arranged on the inner surface of the blade ring 10. Further, the gap between the rotor 2 and the blade ring 10 includes a gap between tip ends of the vanes 4 supported by the blade ring 10 and a surface of the rotor shaft.

In the disassembly or the assembly of the steam turbine 1, a dimension of the gap between the rotor 2 and the blade ring 10 is measured. The position of the blade ring 10 is adjusted by the support devices 5 based on a result of the measurement such that the gap between the rotor 2 and the blade ring 10 has the expected dimension.

Figure 2:
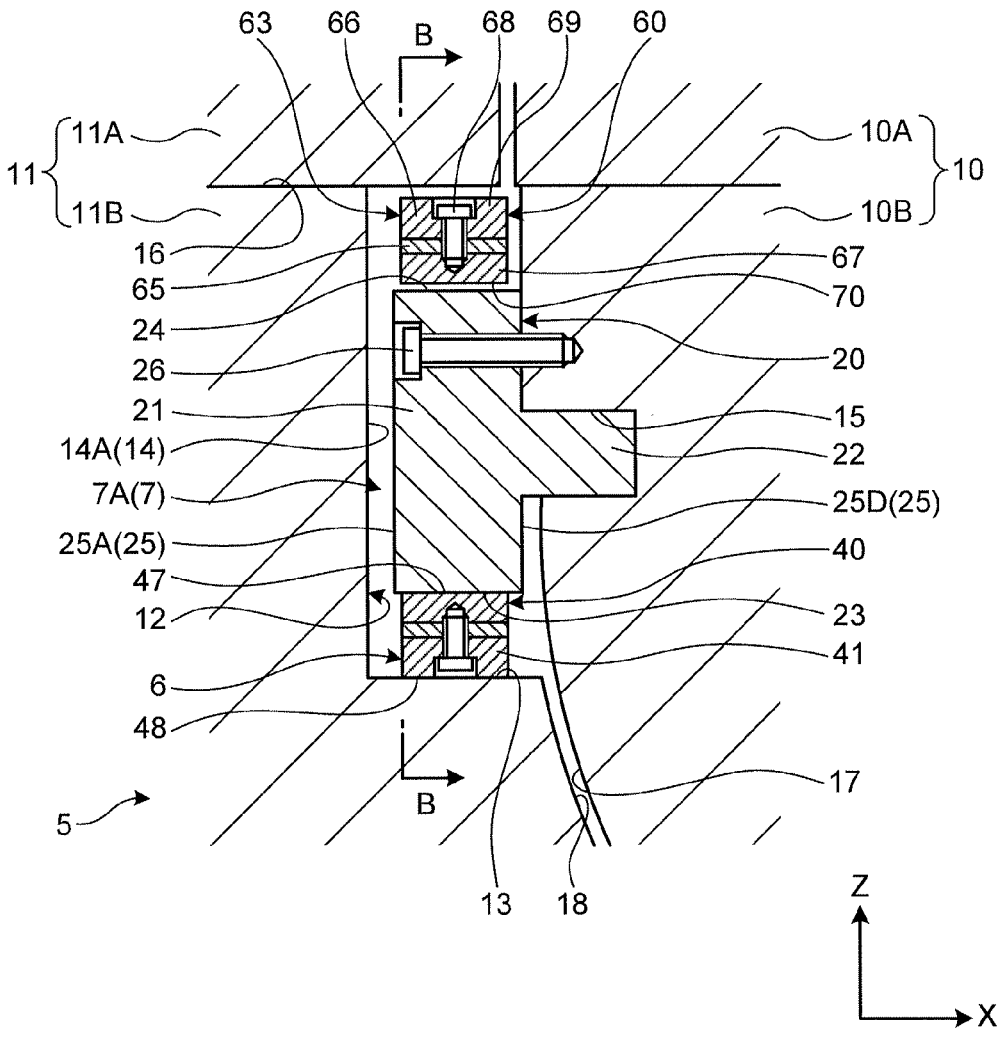
FIG. 2 is a sectional view illustrating an example of a support device according to the first embodiment.
Figure 3:
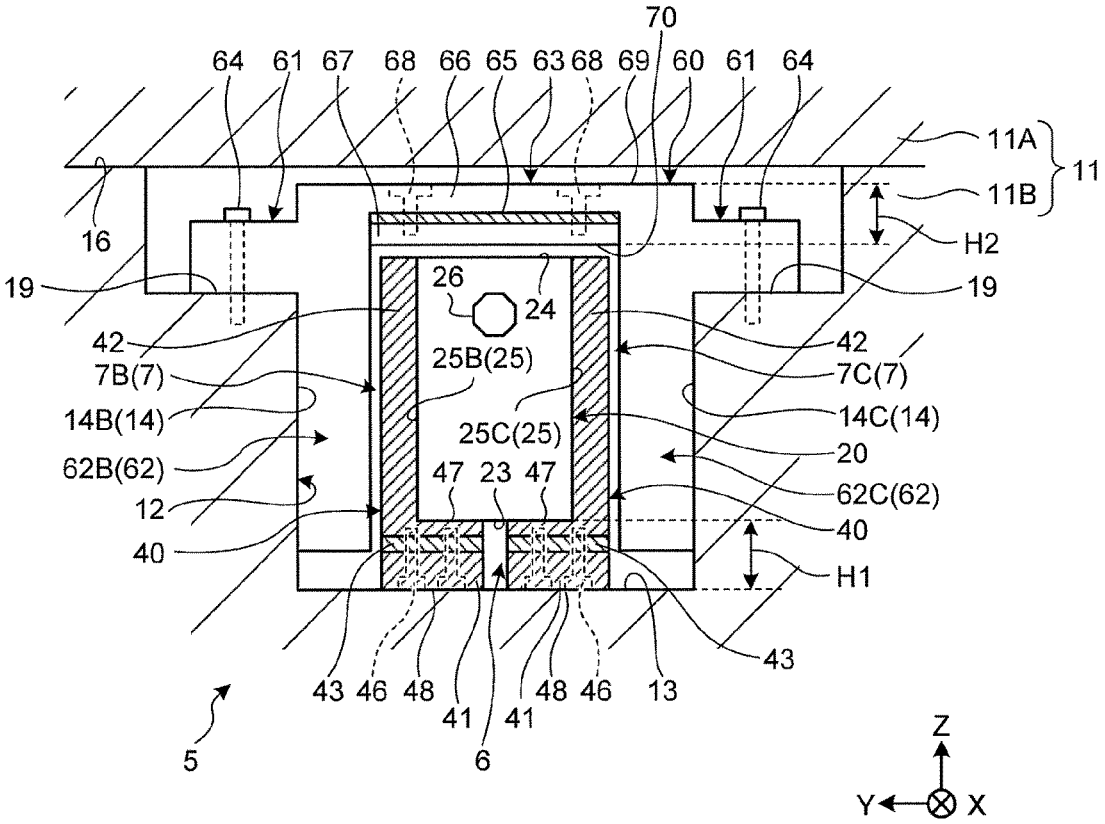
FIG. 3 is a diagram illustrating an example of the support device according to the first embodiment.

Next, an example of the support device 5 according to the present embodiment will be described. FIG. 2 is a sectional view, parallel to the XZ plane, illustrating an example of the support device 5 according to the present embodiment, and corresponds to an area A of FIG. 1. FIG. 3 is a plan view, parallel to the YZ plane, illustrating an example of the support device 5 according to the present embodiment, and corresponds to a B-B arrow view of FIG. 2.

As illustrated in FIGS. 2 and 3, the support device 5 includes a first member 20 that supports the blade ring 10, and a second member 40 that adjusts the position of the first member 20 in the Z axis direction. At least a part of the second member 40 is arranged below the first member 20. When the position of the first member 20 in the Z axis direction is adjusted by the second member 40, the position of the blade ring 10 in the Z axis direction is adjusted.

Further, the support device 5 includes a third member 60 that regulates movement of the adjustment member 40. The third member 60 can regulate movement of both of the first member 20 and the second member 40. At least a part of the third member 60 is arranged above the first member 20 and the second member 40.

In the description below, the first member 20 is appropriately referred to as support member 20, the second member 40 is appropriately referred to as adjustment member 40, and the third member 60 is appropriately referred to as holding member 60.

In the present embodiment, a recessed portion (groove portion) 12 is provided in the lower half portion 11B of the casing 11. The recessed portion 12 is formed so as to notch a part of an upper surface 16 of the lower half portion 11B, and a part of an inner surface 18 of the lower half portion 11B, the inner surface 18 facing an outer surface 17 of the lower half portion 10B of the blade ring 10.

The recessed portion 12 includes an inner surface. The inner surface of the recessed portion 12 includes a bottom surface 13 facing the +Z direction and substantially parallel to the XY plane, and an inner wall surface 14 substantially parallel to the Z axis. The inner wall surface 14 includes an inner wall surface 14A facing +X direction and substantially parallel to the YZ plane, an inner wall surface 14B facing the −Y direction and substantially parallel to the YZ plane, and an inner wall surface 14C facing the +Y direction and substantially parallel to the YZ plane.

In the present embodiment, a recessed portion (hole portion) 15 is provided in the lower half portion 10B of the blade ring 10. The recessed portion 15 is formed in a part of the lower half portion 10B.

At least a part of the support member 20 is fixed to the blade ring 10. At least a part of the support member 20 is arranged in the recessed portion 12. At least a part of the support member 20 is arranged in the recessed portion 15. In the description below, a portion of the support member 20, the portion being arranged in the recessed portion 12 of the casing 11, is appropriately referred to as a main body portion 21, and a portion of the support member 20, the portion being arranged in the recessed portion 15 of the blade ring 10, is appropriately referred to as protruding portion 22.

The main body portion 21 includes a lower surface 23 facing the −Z direction and substantially parallel to the XY plane, an upper surface 24 facing an opposite direction to the lower surface 23, and a side surface 25 connecting a peripheral edge portion of the upper surface 24 and a peripheral edge portion of the lower surface 23. The bottom surface 13 of the recessed portion 12 is positioned below the lower surface 23 of the main body portion 21. The inner wall surface 14 of the recessed portion 12 is positioned in at least a part around the side surface 25 of the main body portion 21.

The side surface 25 includes a side surface (back surface) 25A facing the −X direction and substantially parallel to the YZ plane, a side surface 25B facing the +Y direction and substantially parallel to the YZ plane, a side surface 25C facing the −Y direction and substantially parallel to the YZ plane, and a side surface (front surface) 25D which faces an opposite direction to the side surface 25A and which can face the outer surface 17 of the lower half portion 10B of the blade ring 10.

The protruding portion 22 protrudes from the side surface 25D. The protruding portion 22 is in contact with an inner surface of the recessed portion 15. When the protruding portion 22 is arranged in the recessed portion 15, the support member 20 is fixed to the lower half portion 10B of the blade ring 10. The support member 20 supports the blade ring 10 through the protruding portion 22. Further, in the present embodiment, the support member 20 and the lower half portion 10B of the blade ring 10 are fixed with a bolt member 26.

The main body portion 21 is arranged in the recessed portion 12 in a state where the protruding portion 22 is arranged in the recessed portion 15. The lower surface 23, the upper surface 24, and the side surface 25 are separated from the inner surface of the recessed portion 12 in a state where the protruding portion 22 is arranged in the recessed portion 15. At least a part of the side surface 25D is in contact with the outer surface 17 in a state where the protruding portion 22 is arranged in the recessed portion 15.

The adjustment member 40 includes an adjustment unit 41 arranged in a gap 6 between the lower surface 23 of the main body portion 21 and the bottom surface 13 of the recessed portion 12, and a handle portion 42 arranged in a space 7 around the side surface 25 of the main body portion 21 in a state where the adjustment unit 41 is arranged in the gap 6.

In the present embodiment, two adjustment members 40 are arranged for one support member 20. One of the two adjustment members 40 is arranged at one side (+Y side) of the center of the support member 20 in the Y axis direction, and the other adjustment member 40 is arranged at the other side (−Y side) of the center of the support member 20 in the Y axis direction. Structures of the two adjustment members 40 are substantially equal. In the description below, one of the adjustment members 40 will be mainly described, and description of the other adjustment member 40 is simplified or omitted.

The lower surface 23 of the support member 20 and the bottom surface 13 of the recessed portion 12 are separated, and the gap 6 is formed between the lower surface 23 and the bottom surface 13, in the state where the protruding portion 22 is arranged in the recessed portion 15. The adjustment unit 41 of the adjustment member 40 is arranged in the gap 6. The adjustment unit 41 includes an upper surface 47 that can face the lower surface 23, and a lower surface 48 that can face the bottom surface 13. The adjustment unit 41 is arranged in the gap 6 such that the upper surface 47 and the bottom surface 23 are in contact with each other, and that the lower surface 48 and the bottom surface 13 are in contact with each other.

The space 7 is defined by the side surface 25 of the main body portion 21 and the inner wall surface 14 of the recessed portion 12. That is, the space 7 is a space between the side surface 25 and the inner wall surface 14. The side surface 25 of the support member 20 and the inner wall surface 14 of the recessed portion 12 are separated, and the space 7 is formed between the side surface 25 and the inner wall surface 14, in the state where the protruding portion 22 is arranged in the recessed portion 15. The handle portion 42 of the adjustment member 40 is arranged in the space 7. The handle portion 42 may be in contact with or may be separated from the support member 20 (main body portion 21) in the state where the adjustment unit 41 is arranged in the gap 6.

In the present embodiment, the space 7 includes a space 7A outside the main body portion 21 in the radial direction, a space 7B at one side (+Y side) of the main body portion 21 in the axial direction, and a space 7C at the other side (−Y side) of the main body portion 21 in the axial direction. The space 7A is formed between the side surface (back surface) 25A and the inner wall surface 14A. The space 7B is formed between the side surface 25B and the inner wall surface 14B. The space 7C is formed between the inner wall surface 25C and the inner wall surface 14C. The handle portion 42 and the main body portion 21 are arranged in the Y axis direction in the state where the adjustment unit 41 is arranged in the gap 6. The handle portion 42 of one of the adjustment members 40 is arranged in the space 7B at the +Y side of the main body portion 21. The handle portion 42 of the other adjustment member 40 is arranged in the space 7C at the −Y side of the main body portion 21.

In the present embodiment, the space 7B and the space 7C have a dimension that enables the adjustment unit 41 and the handle portion 42 of the adjustment member 40 to pass through.

Figure 4:
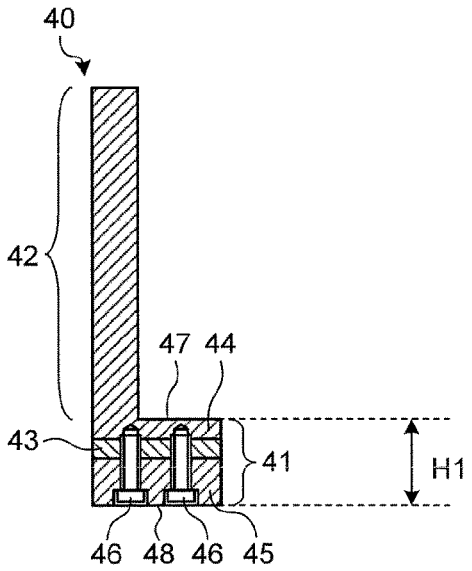
FIG. 4 is a sectional view illustrating an example of an adjustment member according to the first embodiment.

FIG. 4 is a sectional view illustrating an example of the adjustment member 40 according to the present embodiment. As illustrated in FIG. 4, the adjustment member 40 includes the adjustment unit 41 and the handle portion 42. In the present embodiment, the handle portion 42 and at least a part of the adjustment unit 41 are integrally formed. The handle portion 42 and the adjustment unit 41 may be formed of a single member.

In the present embodiment, the adjustment unit 41 includes a detachable liner (shim) 43. The adjustment unit 41 and the handle portion 42 are formed of a single member, and the adjustment unit 41 includes a portion 44 being in contact with an upper surface of the liner 43, and a plate 45 that sandwiches the liner 43 with the portion 44. The portion 44, the liner 43, and the plate 45 are fixed with bolt members 46. The upper surface 47 that can be in contact with the lower surface 23 is arranged on the portion 44. The lower surface 48 that can be in contact with the bottom surface 13 is arranged on the plate 45.

When the thickness of the liner 43 arranged between the portion 44 and the plate 45 is adjusted, a distance (a thickness of the adjustment unit 41) H1 between the upper surface 47 and the lower surface 48 in the Z axis direction is set. In the present embodiment, a plurality of the liners 43 having different thicknesses is prepared, and the liner 43 having an expected thickness selected from the plurality of liners 43 is arranged between the portion 44 and the plate 45, and is fixed with the bolt members 46. Accordingly, the thickness H1 is set. In a case of changing the thickness H1, the fixation with the bolt members 46 is cancelled, and the liner 43 is detached from the portion 44 and the plate 45 and is replaced with the liner 43 having the expected thickness.

When the adjustment unit 41 having the expected thickness H1 is arranged in the gap 6 between the lower surface 23 of the support member 20 and the bottom surface 13 of the recessed portion 12, the position of the support member 20 in the Z axis direction (the position of the support member 20 with respect to the casing 11) is adjusted. When the adjustment unit 41 having a large thickness H1 is arranged in the gap 6, the support member 20 is lifted. That is, when the adjustment unit 41 having a large thickness H1 is arranged in the gap 6, the support member 20 is arranged upward. Conversely, when the adjustment unit 41 having a small thickness H1 is arranged in the gap 6, the support member 20 is arranged downward.

The casing 11 is supported by the frame 100. The position of the casing 11 in the Z axis direction is not substantially moved. The rotor 2 is supported by a frame (not illustrated) through a bearing or the like. The position of the rotor 2 in the Z axis direction is also not substantially moved. The blade ring 10 is supported by the support devices 5 between the casing 11 and the rotor 2 in a displaceable manner. That is, the support devices 5 can relatively displace the blade ring 10 with respect to the casing 11 and the rotor 2 in the Z axis direction. When the adjustment unit 41 having a large thickness H1 is arranged in the gap 6, the support member 20 is displaced upward with respect to the casing 11 and the rotor 2. When the adjustment unit 41 having a small thickness H1 is arranged in the gap 6, the support member 20 is displaced downward with respect to the casing 11 and the rotor 2.

As illustrated in FIGS. 2 and 3, the holding member 60 includes a fixed portion 61 detachably fixed to the lower half portion 11B of the casing 11, a spacer portion 62 arranged in the space 7 in the state where the fixed portion 61 is fixed to the lower half portion 11B of the casing 11, and an adjustment unit 63 arranged above the main body portion 21.

In the present embodiment, the recessed portion 12 includes a support surface 19 arranged above the inner wall surface 14 and facing the +Z direction. The fixed portion 61 is supported by the support surface 19. The fixed portion 61 is fixed to the support surface 19 with a bolt member 64. Accordingly, the holding member 60 is fixed to the lower half portion 11B of the casing 11.

The spacer portion 62 includes a spacer portion 62B arranged in the space 7B and a spacer portion 62C arranged in the space 7C. The spacer portion 62B is arranged between the inner wall surface 14B and the one adjustment member 40 (handle portion 42). The spacer portion 62B is arranged so as to be in contact with the inner wall surface 14B. The spacer portion 62B may be in contact with or separated from the adjustment member 40 in the space 7B. The spacer portion 62C is arranged between the inner wall surface 14C and the other adjustment member 40 (handle portion 42). The spacer portion 62C is arranged so as to be in contact with the inner wall surface 14C. The spacer portion 62C may be in contact with or separated from the adjustment member 40 in the space 7C.

The adjustment unit 63 includes an upper surface 69 that the upper half portion 11A of the casing 11 can face, and a lower surface 70 that the upper surface 24 of the main body portion 21 can face. In the present embodiment, the adjustment unit 63 includes a detachable liner (shim) 65. The adjustment unit 63, the fixed portion 61, and the spacer portion 62 are formed of a single member. The adjustment unit 63 includes a portion 66 that is in contact with an upper surface of the liner 65, and a plate 67 that sandwiches the liner 65 with the portion 66. The portion 66, the liner 65, and the plate 67 are fixed with bolt members 68. The upper surface 69 that can face a lower surface of the upper half portion 11A is arranged on the portion 66. The lower surface 70 that can face the upper surface 24 of the main body portion 21 is arranged on the plate 67.

When the thickness of the liner 65 arranged between the portion 66 and the plate 67 is adjusted, a distance (a thickness of the adjustment unit 63) H2 between the upper surface 69 and the lower surface 70 in the Z axis direction is set. In the present embodiment, a plurality of the liners 65 having different thicknesses is prepared, and the liner 65 having an expected thickness selected from the plurality of liners 65 is arranged between the portion 66 and the plate 67, and is fixed with the bolt members 68. Accordingly, the thickness H2 is set. In a case of changing the thickness H2, the fixation with the bolt members 68 is cancelled, and the liner 65 is detached from between the portion 66 and the plate 67 and is replaced with the liner 65 having the expected thickness.

Next, an example of a support method of the blade ring 10 using the support device 5 according to the present embodiment will be described. The support method of the blade ring 10 with the support device 5 includes a method of adjusting the position of the blade ring 10 in the Z axis direction by the support device 5. FIGS. 5, 6, 7, 8, and 9 are schematic views for describing an example of the support method according to the present embodiment. In the description below, the support device 5 is schematically shown.

Figure 5:
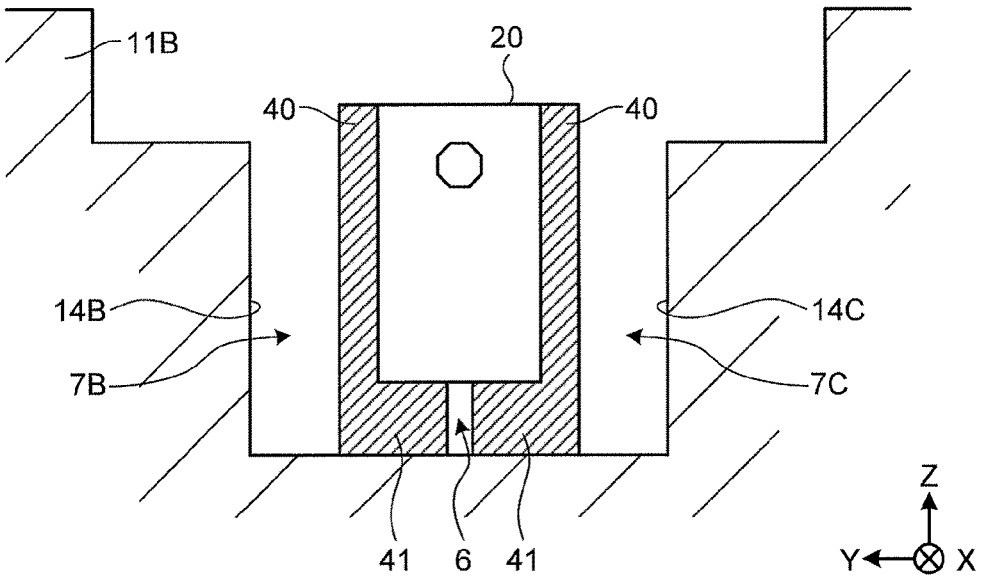
FIG. 5 is a diagram for describing an example of a method of adjusting a position of an inner member according to the first embodiment.

Adjustment work of the position of the blade ring 10 is performed in a state where the operation of the steam turbine 1 is stopped. To perform the adjustment work, as illustrated in FIG. 5, the upper half portion 11A of the casing 11 is detached from the lower half portion 11B of the casing 11, and the upper half portion 10A of the blade ring 10 is detached from the lower half portion 10B of the blade ring 10. Further, the holding member 60 is detached from the lower half portion 11B of the casing 11. The support member 20 is fixed to the blade ring 10.

Replacement of the adjustment member 40 is performed for adjustment of the position of the blade ring 10 in the Z axis direction. As described above, when the adjustment unit 41 of the expected thickness H1 is arranged in the gap 6, the position of the blade ring 10 is adjusted. For example, in a case of changing the position of the blade ring 10 for adjustment of the gap between the rotor 2 and the blade ring 10 based on a measurement result of a dimension of the gap, replacement work of the adjustment member 40 is performed.

Figure 6:
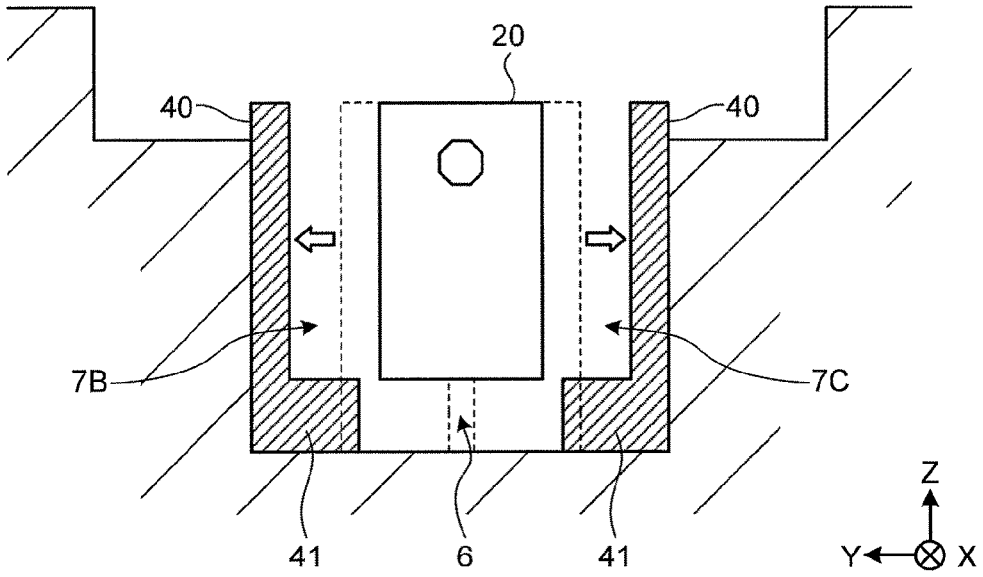
FIG. 6 is a diagram for describing an example of the method of adjusting a position of an inner member according to the first embodiment.

A procedure to detach the adjustment member 40 will be described with reference to FIGS. 5, 6, and 7. In the present embodiment, the adjustment unit 41 is movable so as to change from one to the other of a state where the adjustment unit 41 is arranged in the gap 6 and a state where the adjustment unit 41 is arranged outside the gap 6. In the present embodiment, as illustrated in FIG. 6, the adjustment member 40 is moved such that the adjustment unit 41 arranged in the gap 6 is moved outside the gap 6 in a state where the blade ring 10 is supported by a support mechanism (not illustrated). The support mechanism hangs and supports the blade ring 10, for example.

As illustrated in FIG. 6, in the present embodiment, the adjustment unit 41 (adjustment member 40) is moved in the Y axis direction such that the state where the adjustment unit 41 is arranged in the gap 6 is changed to the state where the adjustment unit 41 is arranged outside the gap 6. That is, one adjustment member 40 is moved in the +Y direction such that the adjustment unit 41 of the one adjustment member 40 is moved from the gap 6 to the space 7B. The other adjustment member 40 is moved in the −Y direction such that the adjustment unit 41 of the other adjustment member 40 is moved from the gap 6 to the space 7C.

Note that the movement of the adjustment member 40 is performed as the handle portion 42 arranged in the space 7 is operated. In the present embodiment, the adjustment member 40 is moved such that the adjustment unit 41 arranged in the gap 6 is moved outside the gap 6, as the handle portion 42 arranged in the space 7 is operated. When the one adjustment member 40 is moved, the handle portion 42 of the one adjustment member 40 arranged in the space 7B is operated. When the other adjustment member 40 is moved, the handle portion 42 of the other adjustment member 40 arranged in the space 7C is operated. The movement of the adjustment member 40 is performed by a moving device (moving tool) or an operator in a state where the handle portion 42 is held by the moving device or the operator. Note that, in work to pull out the adjustment unit 41 from the gap 6, the blade ring 10 (support member 20) may be slightly raised by the support mechanism (not illustrated). Accordingly, the work to pull out the adjustment unit 41 from the gap 6 is smoothly performed.

In a case where the adjustment member 40 is moved such that the state where the adjustment unit 41 is arranged in the gap 6 is changed to the state where the adjustment unit 41 is arranged in the space 7B, the dimension of the space 7B in the Y axis direction is a dimension that allows the movement of the adjustment member 40. Further, the space 7B has a dimension that enables the entire adjustment member 40 including the adjustment unit 41 and the handle portion 42 to pass through. The same applies to the space 7C.

Figure 7:
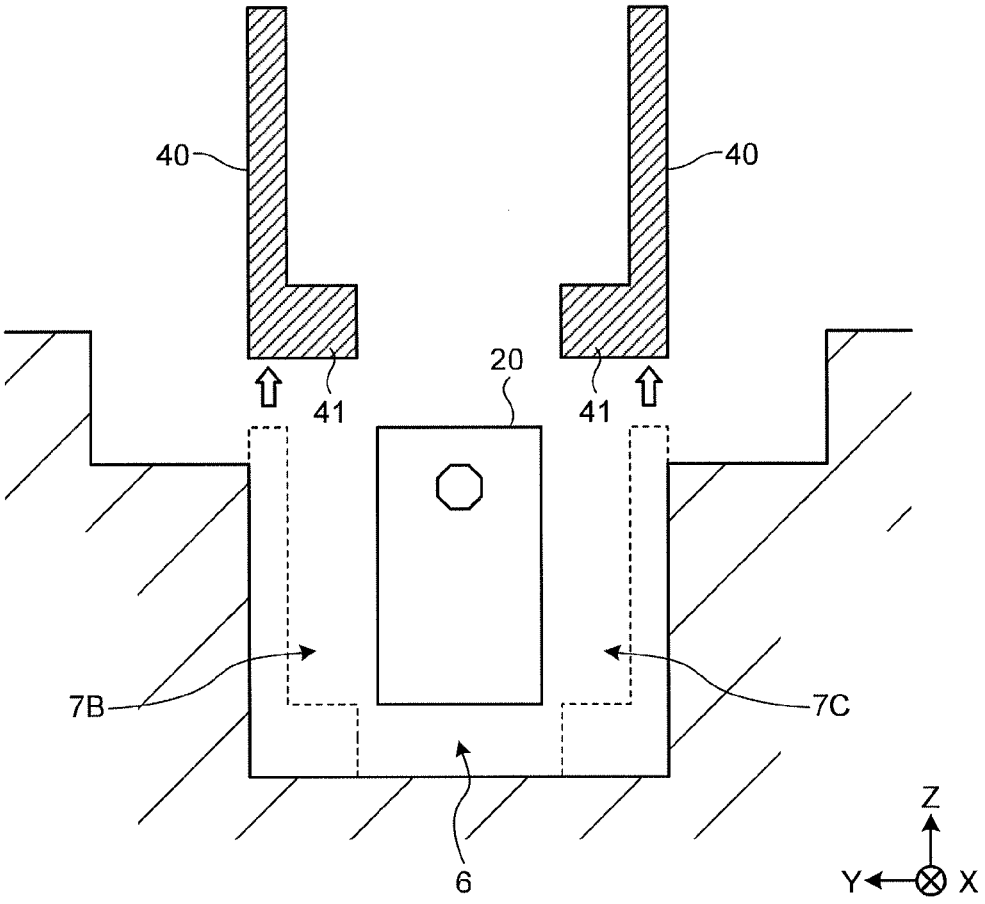
FIG. 7 is a diagram for describing an example of the method of adjusting a position of an inner member according to the first embodiment.

As illustrated in FIG. 7, after the adjustment unit 41 is arranged in the space 7B (space 7C), the adjustment member 40 rises to pass through the space 7B (space 7C). That is, the adjustment member 40 is moved such that the adjustment unit 41 moved into the space 7B (7C) outside the gap 6 passes through the space 7B (7C). Accordingly, the adjustment member 40 is detached from the recessed portion 12 (casing 11). The blade ring 10 is supported by the support mechanism (not illustrated). Therefore, the position of the blade ring 10 is maintained even if the adjustment member 40 is detached.

Next, a procedure to attach the adjustment member 40 will be described with reference to FIGS. 8 and 9. To adjust the support member 20 (blade ring 10) to an expected position, the thickness H1 of the adjustment unit 41 is adjusted. The liner 43 is selected such that the adjustment unit 41 has the expected thickness H1. After the adjustment member 40 including the adjustment unit 41 having the expected thickness H1 is acquired, the adjustment unit 41 of the adjustment member 40 is arranged in the gap 6. That is, the adjustment member 40 is attached to the recessed portion 12 in a procedure opposite to the procedure described with reference to FIGS. 5, 6, and 7.

Figure 8:
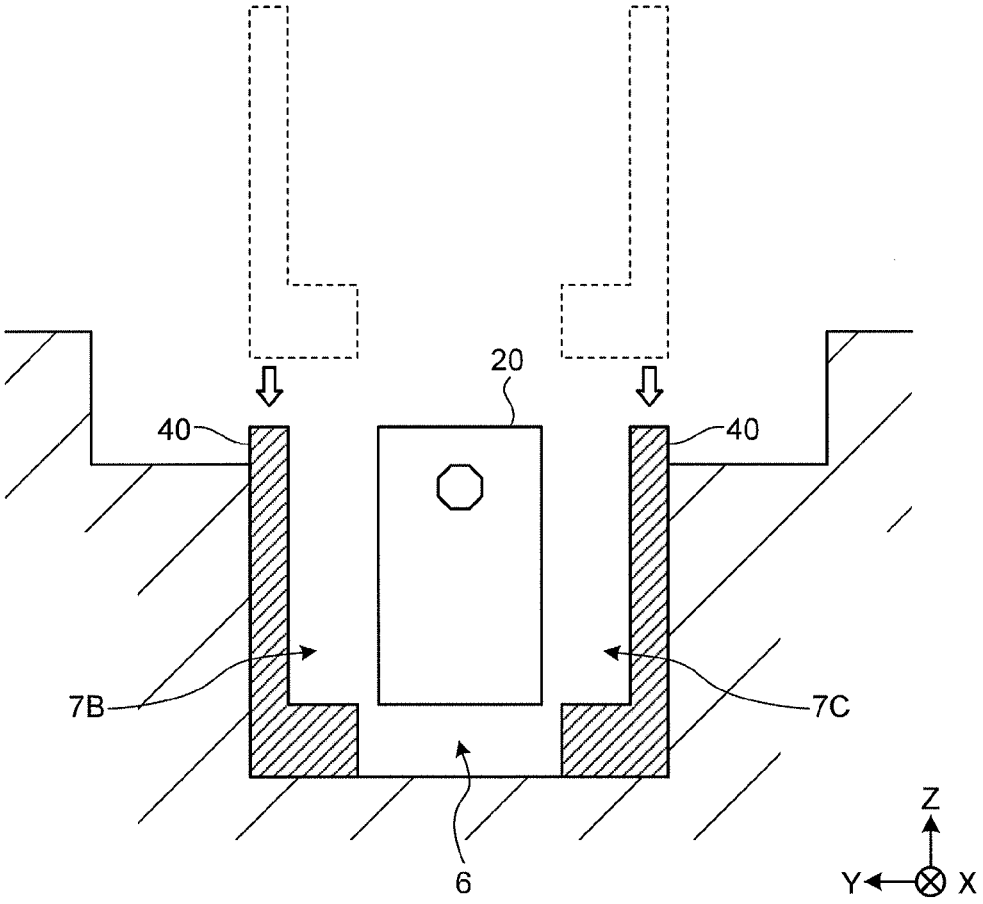
FIG. 8 is a diagram for describing an example of the method of adjusting a position of an inner member according to the first embodiment.
Figure 9:
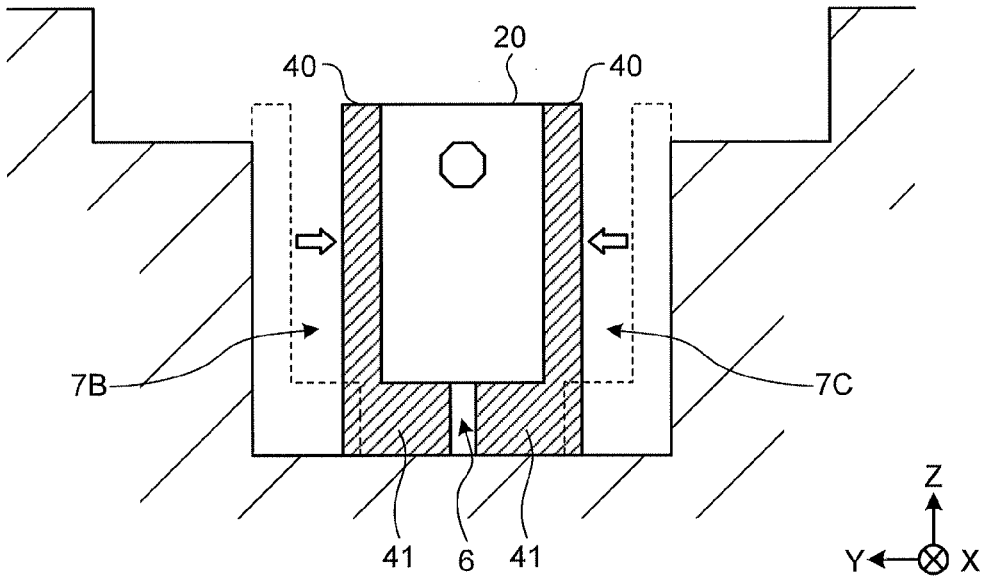
FIG. 9 is a diagram for describing an example of the method of adjusting a position of an inner member according to the first embodiment.

That is, as illustrated in FIG. 8, the adjustment unit 41 with the adjusted thickness H1 is lowered and passes through the space 7B (7C), and the adjustment member 40 is arranged in the space 7B (space 7C). Following that, as illustrated in FIG. 9, the adjustment member 40 is moved in the Y axis direction such that the state where the adjustment unit 41 is arranged outside the gap 6 is changed to the state where the adjustment unit 41 is arranged in the gap 6. Accordingly, the adjustment member 40 is attached to the recessed portion 12, and the adjustment unit 41 is arranged in the gap 6. After the adjustment unit 41 is arranged in the gap 6, the support to the blade ring 10 by the support mechanism (not illustrated) is cancelled. Accordingly, the blade ring 10 is supported by the casing 11 through the adjustment unit 41 (adjustment member 40) arranged in the gap 6 and the support member 20. The blade ring 10 is positioned to a position (a position in the Z axis direction) based on the thickness H1 of the adjustment unit 41.

Following that, the holding member 60 is fixed to the lower half portion 11B of the casing 11. In the present embodiment, in a case where the thickness H1 has been changed, the thickness H2 is also adjusted (changed) based on the thickness H1. In the present embodiment, the thickness H2 is adjusted based on the thickness H1 such that the distance between the upper surface 47 of the adjustment unit 41 and the lower surface 70 of the adjustment unit 63 (the distance in the Z axis direction) is maintained to be a fixed value. For example, when the thickness H1 of the adjustment unit 41 has become large, the thickness H2 of the adjustment unit 63 is adjusted to become small. When the thickness H1 of the adjustment unit 41 has become small, the thickness H2 of the adjustment unit 63 is adjusted to become large. Accordingly, the support member 20 is smoothly arranged between the upper surface 47 and the lower surface 70 before and after the change of the thickness H1.

The holding member 60 is fixed with the casing 11 in the fixed portion 61. That is, relative positions of the fixed portion 61 and the spacer portion 62, and the casing 11 are substantially unchanged before and after the change of the thickness H1. Meanwhile, the support member 20 is displaced in the Z axis direction by the change of the thickness H1. Therefore, if the thickness H2 of the adjustment unit 63 arranged above the support member 20 is not changed, the relative positions (distance) of the upper surface 24 of the support member 20 and the lower surface 70 of the adjustment unit 63 are changed. For example, if the thickness H2 (the height of the lower surface 70) is not changed despite the thickness H1 having become large, the upper surface 24 and the lower surface 70 come in contact with each other with strong force, and stress concentration may occur. Further, the support member 20 may not be positioned to the expected position in the Z axis direction. Conversely, if the thickness H2 (the height of the lower surface 70) is not changed despite the thickness H1 having become small, the dimension of the gap between the upper surface 24 and the lower surface 70 becomes large, and the holding member 60 may not be able to sufficiently hold the support member 20 and the adjustment member 40. As a result, for example, the support member 20 (blade ring 10) may rise up at the time of disassembly of the steam turbine 1, or the support member 20 (blade ring 10) may cause undesired displacement during the operation of the steam turbine 1.

In the present embodiment, the thickness H2 is changed based on the thickness H1. Therefore, the holding member 60 can smoothly hold the support member 20 and the adjustment member 40.

After the holding member 60 is fixed to the casing 11, the upper half portion 10A of the blade ring 10 and the lower half portion 10B of the blade ring 10 are joined. After that, the upper half portion 11A of the casing 11 and the lower half portion 11B of the casing 11 are joined.

As described above, according to the present embodiment, the adjustment member 40 including the adjustment unit 41 having the expected thickness H1 is replaced in the state where the support member 20 is fixed to the blade ring 10, so that the position of the support member 20 in the vertical direction can be smoothly adjusted. Further, in the present embodiment, the adjustment unit 41 and at least a part of the handle portion 42 are integrated, and the adjustment member 40 is moved in the state where the handle portion 42 is held, whereby the replacement of the adjustment member 40 can be smoothly performed. Further, the space 7 (7B, 7C) has the dimension that enables the adjustment unit 41 to pass through, and thus the adjustment member 40 can be smoothly replaced through the space 7 in the state where the support member 20 is fixed to the blade ring 10.

In the present embodiment, after the upper half portion 11A is detached from the lower half portion 11B of the casing 11, and the upper half portion 10B is detached from the lower half portion 10A of the blade ring 10, the replacement work of the adjustment member 40 can be performed without detaching the rotor 2. Further, after the replacement work of the adjustment member 40, the upper half portion 10A and the lower half portion 10B of the blade ring 10 can be joined and the upper half portion 11A and the lower half portion 11B of the casing 11 can be joined without moving the rotor 2. Accordingly, the replacement work of the adjustment member 40 is smoothly performed without detaching the rotor 2, and thus the adjustment work of the position of the blade ring 10 can be smoothly performed. Therefore, a decrease in an operation rate of the steam turbine 1 can be suppressed.

Further, in the present embodiment, the thickness H1 of the adjustment unit 41 can be easily adjusted only by replacement of the liner 43.

Further, in the present embodiment, the space 7B and the space 7B are provided at one side and the other side of the main body portion 21 in the Y axis direction. In the replacement work of the adjustment member 40, the adjustment member 40 is moved in the Y axis direction. Therefore, the dimension of the space 7A in the radial direction with respect to the rotational axis AX can be made small. Therefore, the dimension of the casing 11 in the radial direction with respect to the rotational axis can be made small.

Further, in the present embodiment, the movement of the adjustment member 40 and the support member 20 is regulated by the holding member 60, and thus displacement of the blade ring 10 is suppressed after the adjustment work of the position of the blade ring 10.

Further, in the present embodiment, the thickness H2 of the adjustment unit 63 of the holding member 60 can be adjusted. In a case where the thickness H1 of the adjustment unit 41 has been changed, the thickness H2 of the adjustment unit 63 is changed based on the thickness H1 of the adjustment unit 41 such that the dimension (the distance in the Z axis direction) of the gap between the upper surface 47 of the adjustment unit 41 and the lower surface 70 of the adjustment unit 63 is maintained constant, whereby the main body portion 21 can be smoothly kept arranged between the adjustment unit 41 and the adjustment unit 63 before and after the change of the thickness H1 of the adjustment unit 41.

Further, in the present embodiment, the handle portion 42 and at least a part of the adjustment unit 41 are formed of a single member. Therefore, it is not necessary to manufacture a plurality of members. In the replacement work of the adjustment member 40, the handle portion 42 is held and the adjustment unit 41 can be easily moved (replaced).

Figure 10:
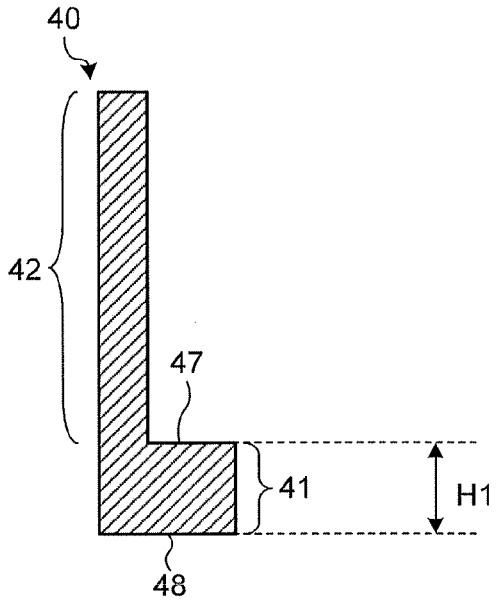
FIG. 10 is a sectional view illustrating an example of the adjustment member according to the first embodiment.

FIG. 10 is a sectional view illustrating another example of the adjustment member 40 according to the present embodiment. As illustrated in FIG. 10, all of the adjustment unit 41 and the handle portion 42 may be formed of a single member. In the example illustrated in FIG. 10, the adjustment member 40 does not include a liner (43). In the example illustrated in FIG. 10, a plurality of the adjustment members 40 having different thicknesses H1 is prepared, and the adjustment member 40 having an expected thickness H1 is selected from the plurality of adjustment members 40. The same applies to the embodiments below.

Note that, in the present embodiment, all of the holding member 60 may be formed of a single member. That is, the adjustment unit 63 may not include the liner (65). A plurality of the holding members 60 having different thicknesses H2 may be prepared, and the holding member 60 having an expected thickness H2 may be selected from the plurality of holding members 60. The same applies to the embodiments below.

Second Embodiment

A second embodiment will be described. In the description below, the constituent portions that are the same as or equivalent to those of the above embodiment are denoted with the same reference signs, and description thereof is simplified or omitted.

Figure 11:
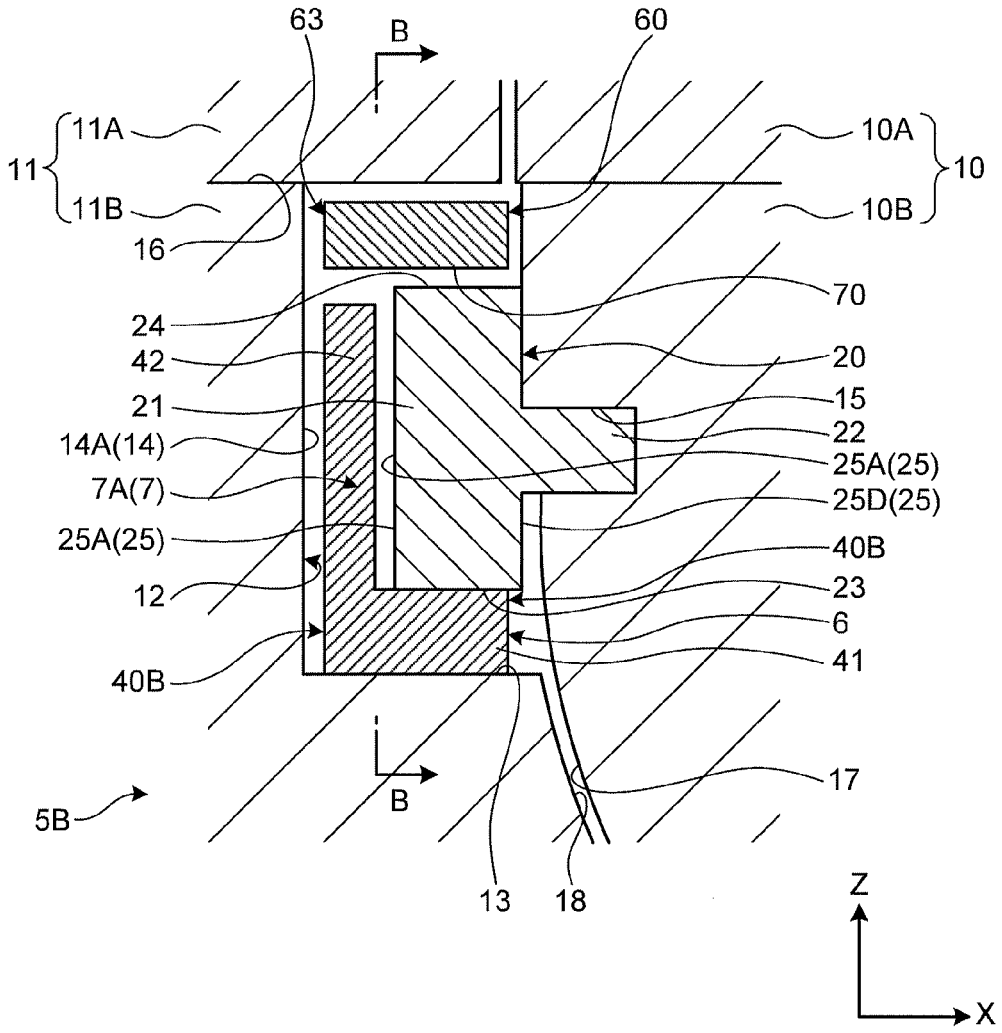
FIG. 11 is a sectional view illustrating an example of a support device according to a second embodiment.
Figure 12:
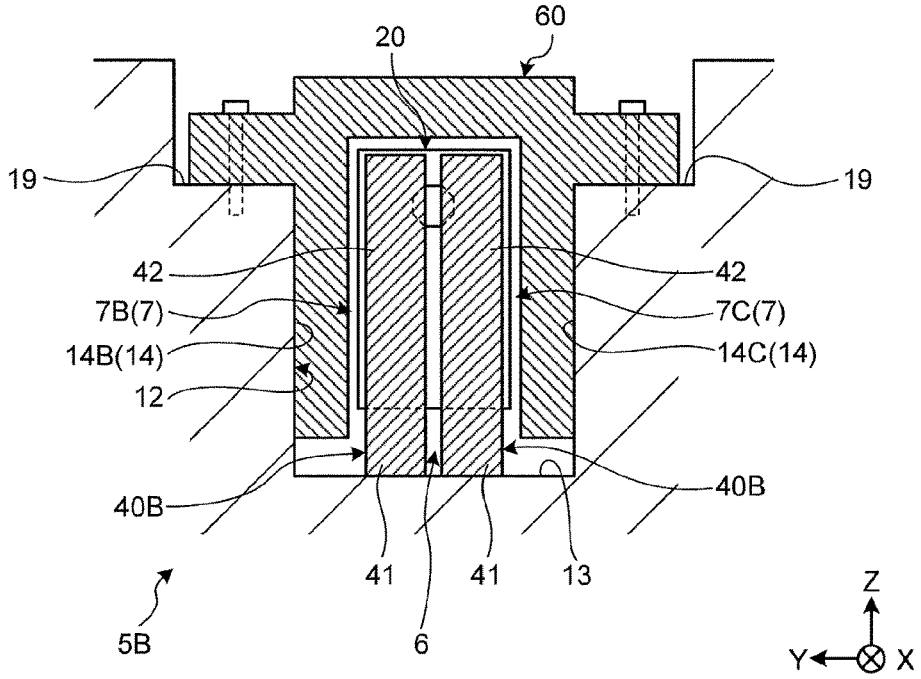
FIG. 12 is a diagram illustrating an example of the support device according to the second embodiment.

FIGS. 11 and 12 are diagrams illustrating an example of a support device 5B according to the present embodiment. FIG. 11 is a sectional view of the support device 5B. FIG. 12 corresponds to a B-B arrow view of FIG. 11. As illustrated in FIGS. 11 and 12, the support device 5B includes a support member 20 having at least a part fixed to a lower half portion 10B of a blade ring 10, an adjustment member 40B that adjusts the position of the support member 20, and a holding member 60 that holds the support member 20 and the adjustment member 40B.

In the present embodiment, a handle portion 42 of the adjustment member 40B is arranged outside a main body portion 21 in a radial direction with respect to a rotational axis AX of a rotor 2, in a state where an adjustment unit 41 of the adjustment member 40B is arranged in a gap 6. That is, the handle portion 42 is arranged in a space 7A in a state where the adjustment unit 41 is arranged in the gap 6.

Figure 13:
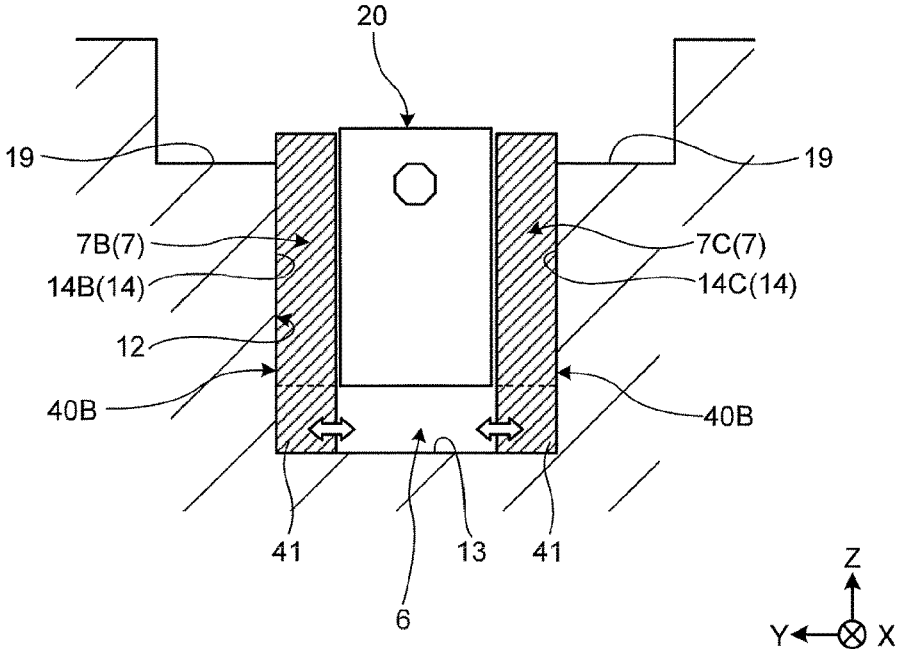
FIG. 13 is a diagram for describing an example of a method of adjusting a position of an inner member according to the second embodiment.

FIG. 13 is a diagram illustrating an example of replacement work of the adjustment member 40B. In the replacement work of the adjustment member 40B, the adjustment member 40B is moved in the Y axis direction in a state where the holding member 60 is detached. The adjustment member 40B is moved in the Y axis direction such that one state where the adjustment unit 41 is arranged in the gap 6 is changed to the other state where the adjustment unit 41 is arranged in a space 7B (space 7C) outside the gap 6. In the replacement work, the adjustment member 40B is moved in the Z axis direction to pass through the space 7B (space 7C).

As described above, in the present embodiment, the handle portion 42 is arranged in the space (first partial space) 7A in the state where the adjustment unit 41 is arranged in the gap 6. In the replacement work of the adjustment member 40B, the adjustment unit 41 passes through a different space (second partial space) 7B (7C) from the space (first partial space) 7A. In the present embodiment, the space 7 includes the first partial space 7A where the handle portion 42 is arranged, and the second partial space 7B (7C) where the adjustment unit 41 passes through. The first partial space 7A is provided in the radial direction with respect to the rotational axis AX with respect to the main body portion 21. The second partial space 7B (7C) is provided in an axial direction along the rotational axis AX with respect to the main body portion 21.

As described above, in the state where the adjustment unit 41 is arranged in the gap 6, the handle portion 42 may be arranged outside the main body portion 41 in the radial direction with respect to the rotational axis AX. Accordingly, the dimension of the adjustment member 40 in the Y axis direction can be made small. Further, even if the dimensions of the space 7B and space 7C in the Y axis direction are made small, the adjustment member 40B can pass through the space 7B and the space 7C. As described above, an increase in sizes of the space 7B and the space 7C can be suppressed. An increase in a size of the space 7A is also suppressed.

Third Embodiment

A third embodiment will be described. In the description below, the constituent portions that are the same as or equivalent to those of the above embodiments are denoted with the same reference signs, and description thereof is simplified or omitted.

Figure 14:
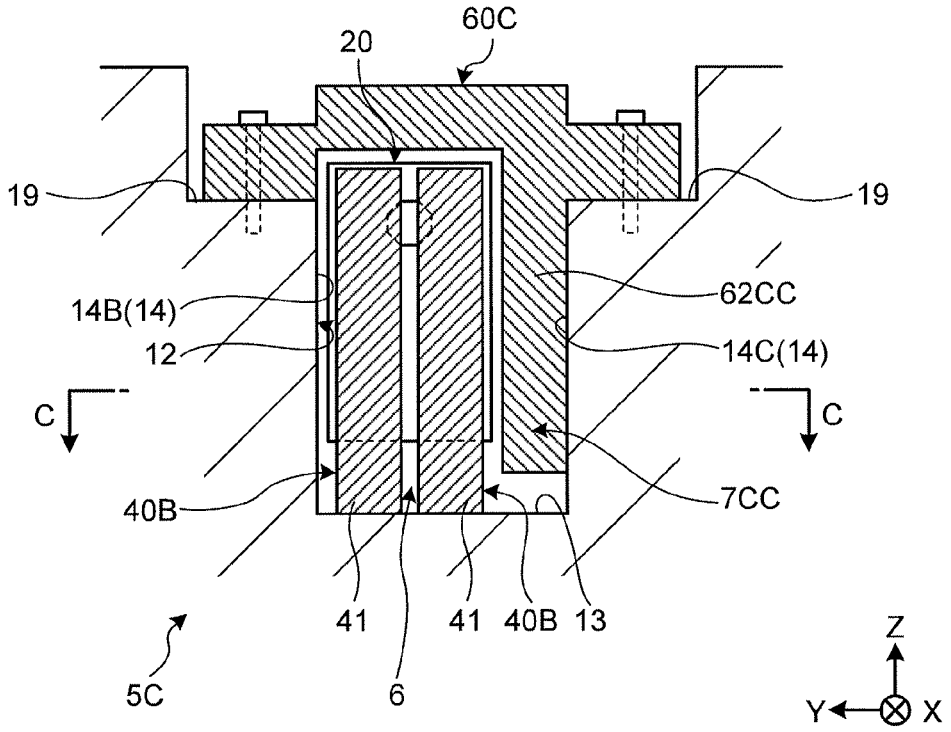
FIG. 14 is a diagram illustrating an example of a support device according to a third embodiment.
Figure 15:
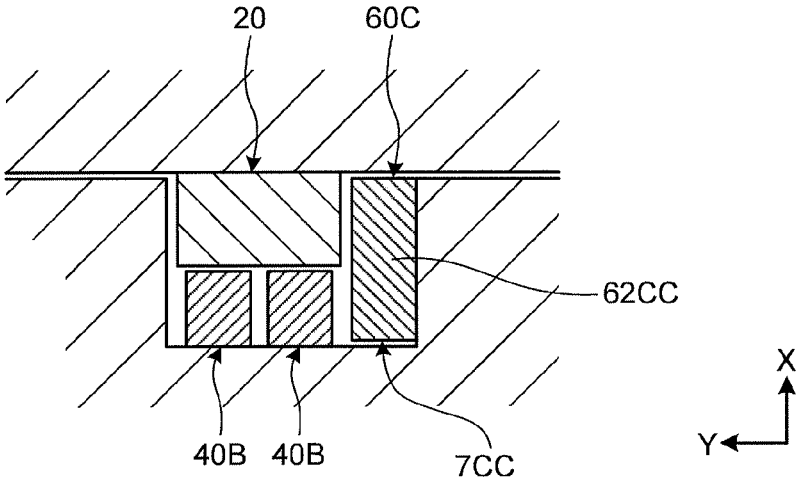
FIG. 15 is a sectional view illustrating an example of the support device according to the third embodiment.

FIGS. 14 and 15 are diagrams illustrating an example of a support device 5C according to the present embodiment. FIG. 14 is a sectional view of the support device 5C. FIG. 15 corresponds to a C-C arrow view of FIG. 14. As illustrated in FIGS. 14 and 15, the support device 5C includes a support member 20 having at least a part fixed to a lower half portion 10B of a blade ring 10, an adjustment member 40B that adjusts the position of the support member 20, and a holding member 60C that holds the support member 20 and the adjustment member 40B.

A handle portion 42 of the adjustment member 40B is arranged outside a main body portion 21 in a radial direction with respect to a rotational axis AX of a rotor 2 in a state where an adjustment unit 41 of the adjustment member 40B is arranged in a gap 6. That is, the handle portion 42 is arranged in a space 7A in the state where the adjustment unit 41 is arranged in the gap 6.

In the present embodiment, a space 7CC where the adjustment member 40D can pass through is provided only at a −Y side of the main body portion 21, and is not provided at a +Y side. A holding member 60 includes a spacer portion 62CC arranged in the space 7CC.

Figure 16:
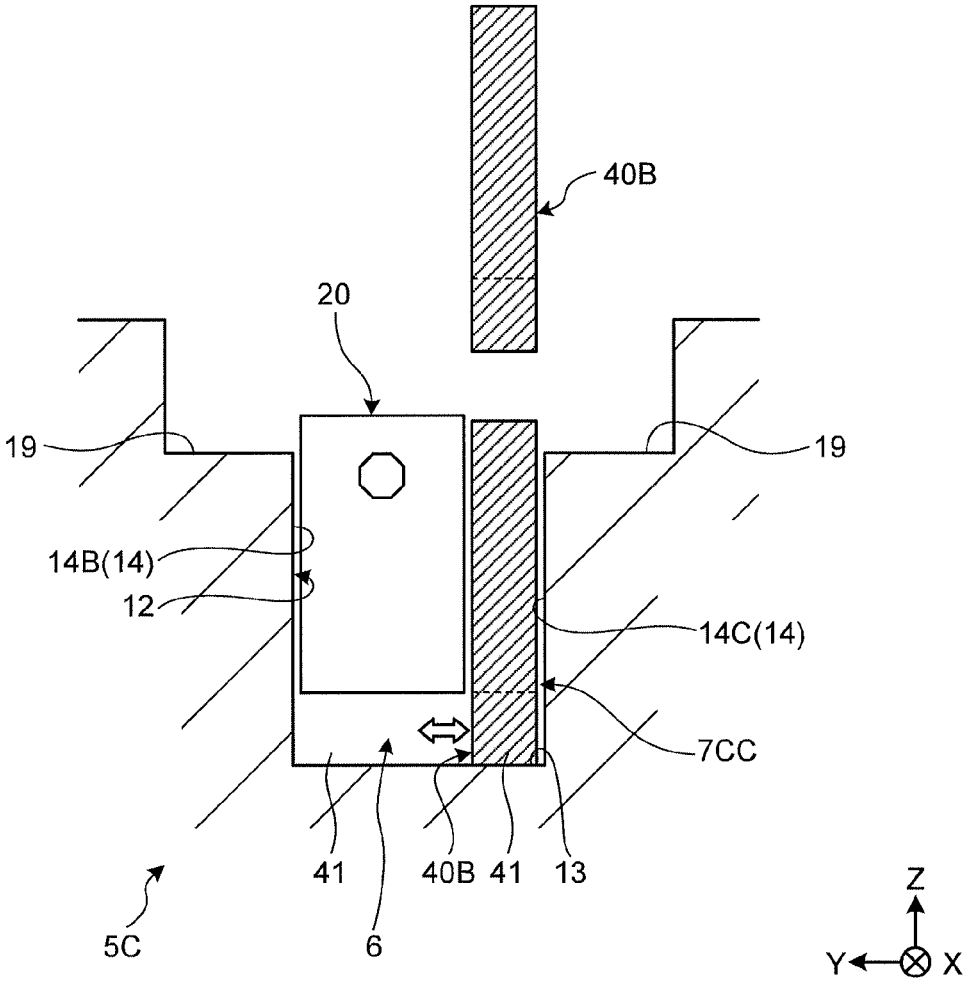
FIG. 16 is a diagram for describing an example of a method of adjusting a position of an inner member according to the third embodiment.

FIG. 16 is a diagram illustrating an example of replacement work of the adjustment member 40B. In the replacement work of the adjustment member 40B, the adjustment member 40B is moved in a Y axis direction in a state where a holding member 60C is detached. The adjustment member 40B is moved in the Y axis direction such that one state where the adjustment unit 41 is arranged in the gap 6 is changed to the other state where the adjustment unit 41 is arranged in the space 7CC outside the gap 6. In the replacement work, the adjustment member 40B is moved in the Z axis direction to pass through the space 7CC.

In the present embodiment, in a case of detaching two adjustment members 40B from a recessed portion 12, both of the two adjustment members 40B are moved in a −Y direction such that a state where the two adjustment members 40B are arranged in the gap 6 is changed to a state where the two adjustment members 40B are arranged in the space 7CC. In a case of installing two adjustment members 40B, the two adjustment members 40B are moved in a +Y direction such that a state where both of the two adjustment members 40B are arranged in the space 7CC is changed to a state where the two adjustment members 40B are arranged in the gap 6.

As described above, the space 7 where the adjustment member 40B passes through may be formed only at one side of the main body portion 21 in the axial direction.

Fourth Embodiment

A fourth embodiment will be described. In the description below, the constituent portions that are the same as or equivalent to those of the above embodiments are denoted with the same reference signs, and description thereof is simplified or omitted.

Figure 17:
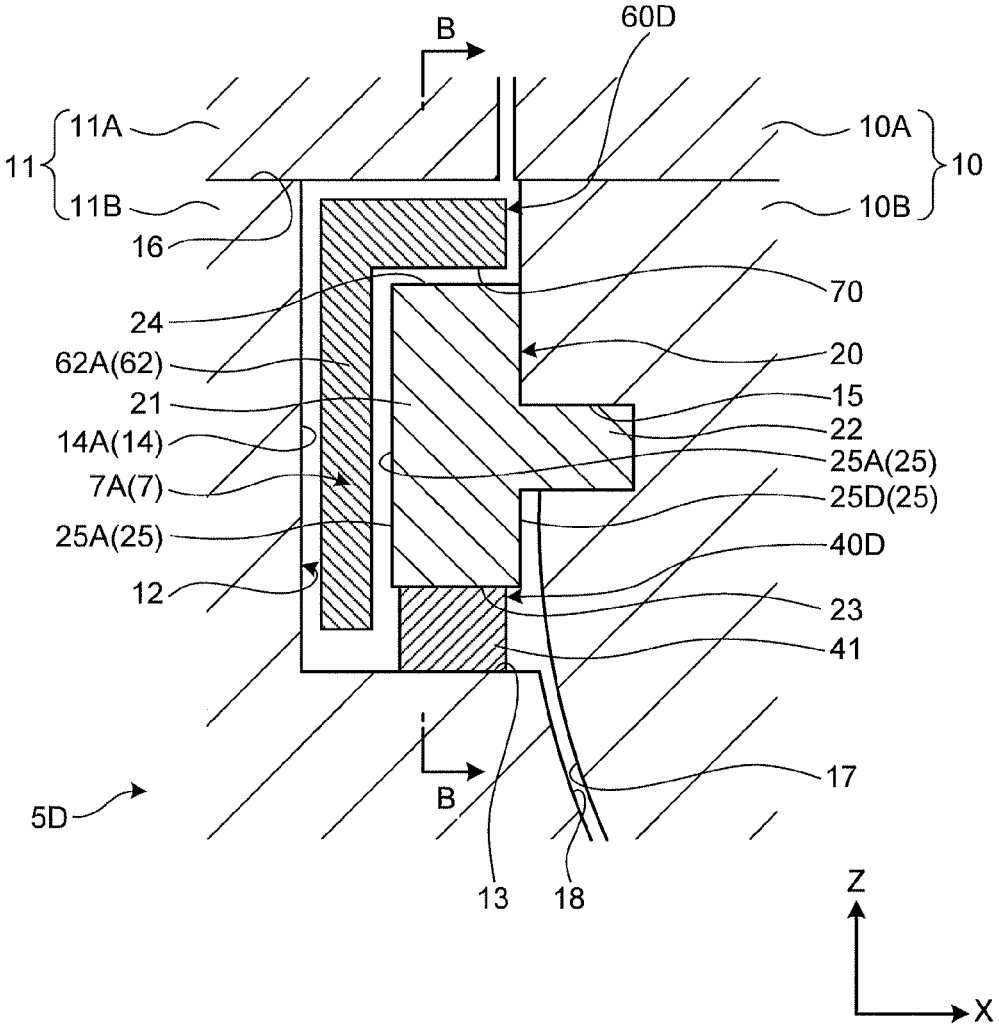
FIG. 17 is a sectional view illustrating an example of a support device according to a fourth embodiment.
Figure 18:
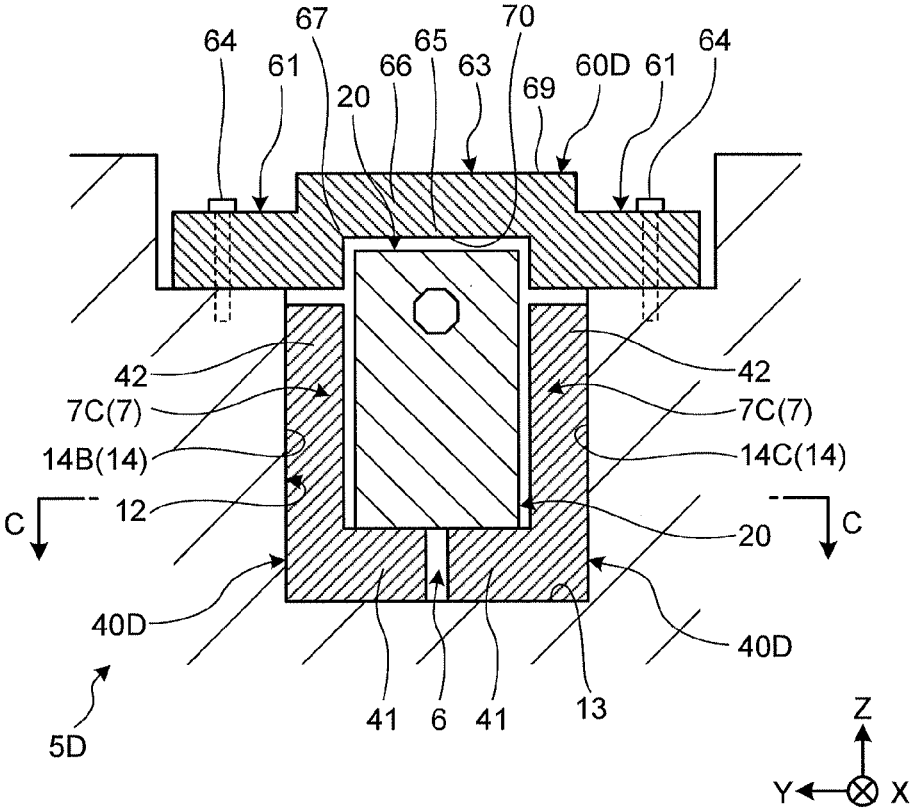
FIG. 18 is a diagram illustrating an example of the support device according to the fourth embodiment.
Figure 19:
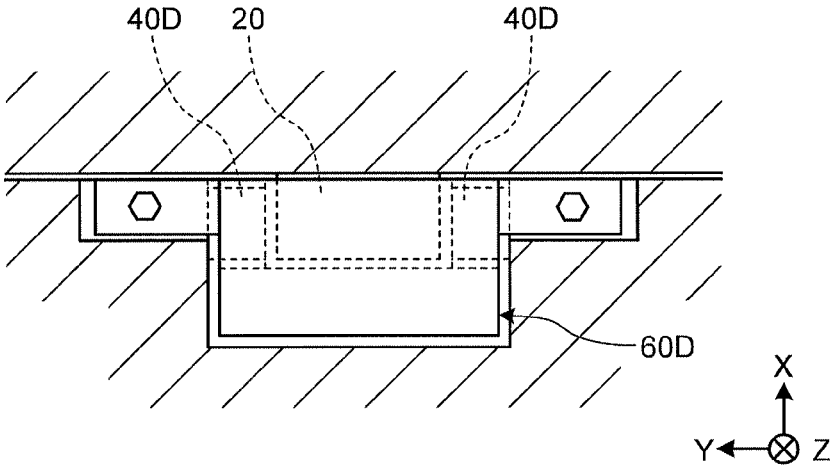
FIG. 19 is a diagram illustrating an example of the support device according to the fourth embodiment.
Figure 20:
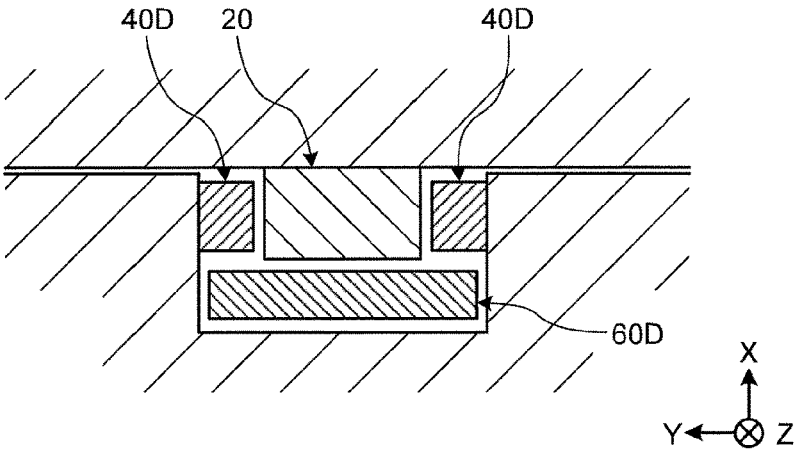
FIG. 20 is a sectional view illustrating an example of the support device according to the fourth embodiment.

FIGS. 17, 18, 19, and 20 are diagrams illustrating an example of a support device 5D according to the present embodiment. FIG. 17 is a sectional view of the support device 5D. FIG. 18 corresponds to a B-B arrow view of FIG. 17. FIG. 19 is a view of the support device 5D as viewed from above. FIG. 20 corresponds to a C-C arrow view of FIG. 18.

The support device 5D includes a support member 20 having at least a part fixed to a lower half portion 10B of a blade ring 10, an adjustment member 40D that adjusts the position of the support member 20, and a holding member 60D that holds the support member 20 and the adjustment member 40D.

A handle portion 42 of one adjustment member 40D is arranged in a space 7B at one side (+Y side) of a main body portion 21 in an axial direction parallel to a rotational axis AX of a rotor 2 in a state where an adjustment unit 41 is arranged in a gap 6. A handle portion 42 of the other adjustment member 40D is arranged in a space 7C at the other side (−Y side) of the main body portion 21 in the axial direction parallel to the rotational axis AX of the rotor 2 in a state where an adjustment unit 41 is arranged in the gap 6.

In the present embodiment, a holding member 60D includes a spacer portion 62A arranged in a space 7A. In the present embodiment, the spacer portion 62 is not arranged in the space 7B and the space 7C.

In the present embodiment, in replacement of an adjustment member 40D, the adjustment unit 41 passes through the space 7A outside the main body portion 41 in a radial direction with respect to the rotational axis AX of the rotor 2. In the present embodiment, the adjustment member 40D is moved in the radial direction (radius direction) such that one state where the adjustment unit 41 is arranged in the gap 6 is changed to the other state where the adjustment unit 41 is arranged in the space 7A outside the gap 6.

As described above, in the present embodiment, the handle portion 42 is arranged in the space (second partial space) 7B (7C) in the state where the adjustment unit 41 is arranged in the gap 6. In the replacement work of the adjustment member 40D, the adjustment unit 41 passes through the different space (first partial space) 7A from the space (second partial space) 7B (7C). In the present embodiment, the space 7 includes the second partial space 7B (7C) where the handle portion 42 is arranged, and the first partial space 7A where the adjustment unit 41 passes through. The first partial space 7A is provided in the radial direction with respect to the rotational axis AX with respect to the main body portion 41. The second partial space 7B (7C) is provided in the axial direction along the rotational axis AX with respect to the main body portion 41.

As described above, the space 7 where the adjustment member 40D passes through may be arranged outside the main body portion 21 in the radial direction. In replacement of the adjustment member 40D, the adjustment member 40D may be moved in the radial direction.

Accordingly, an increase in sizes of the space 7A and the space 7B (7C) is suppressed.

Fifth Embodiment

A fifth embodiment will be described. In the description below, the constituent portions that are the same as or equivalent to those of the above embodiments are denoted with the same reference signs, and description thereof is simplified or omitted.

Figure 21:
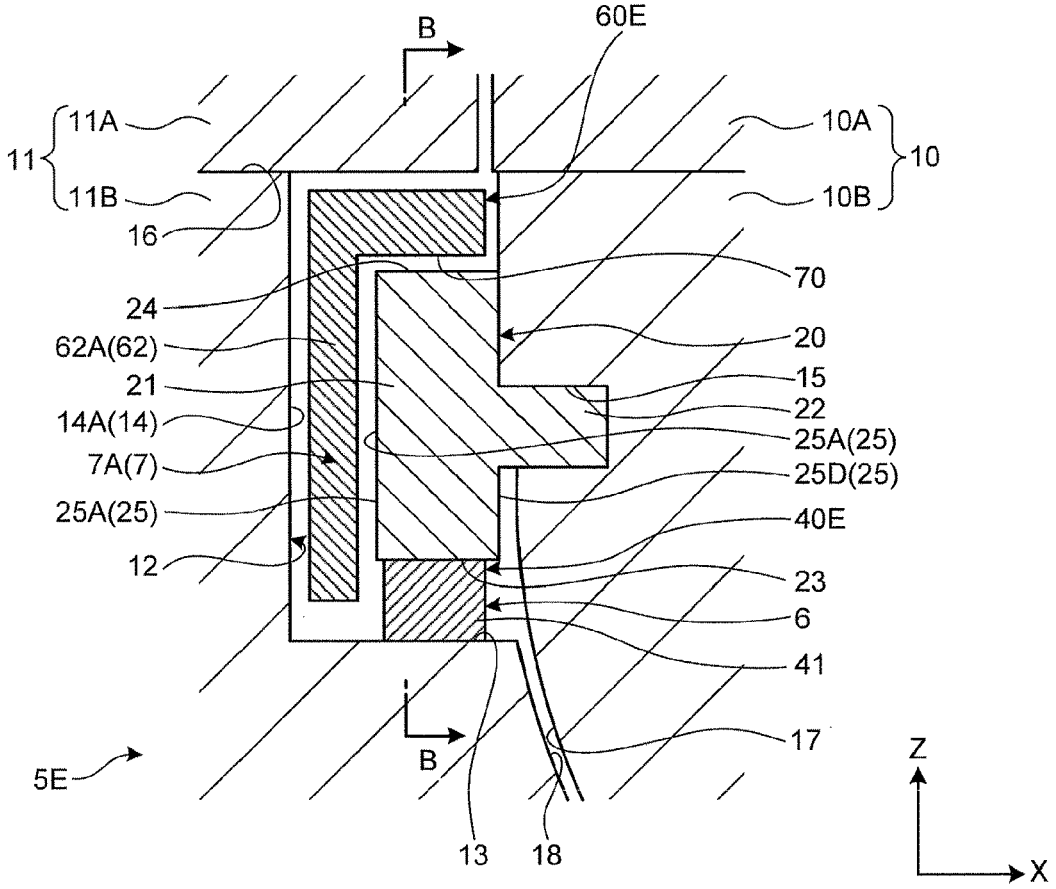
FIG. 21 is a sectional view illustrating an example of a support device according to a fifth embodiment.
Figure 22:
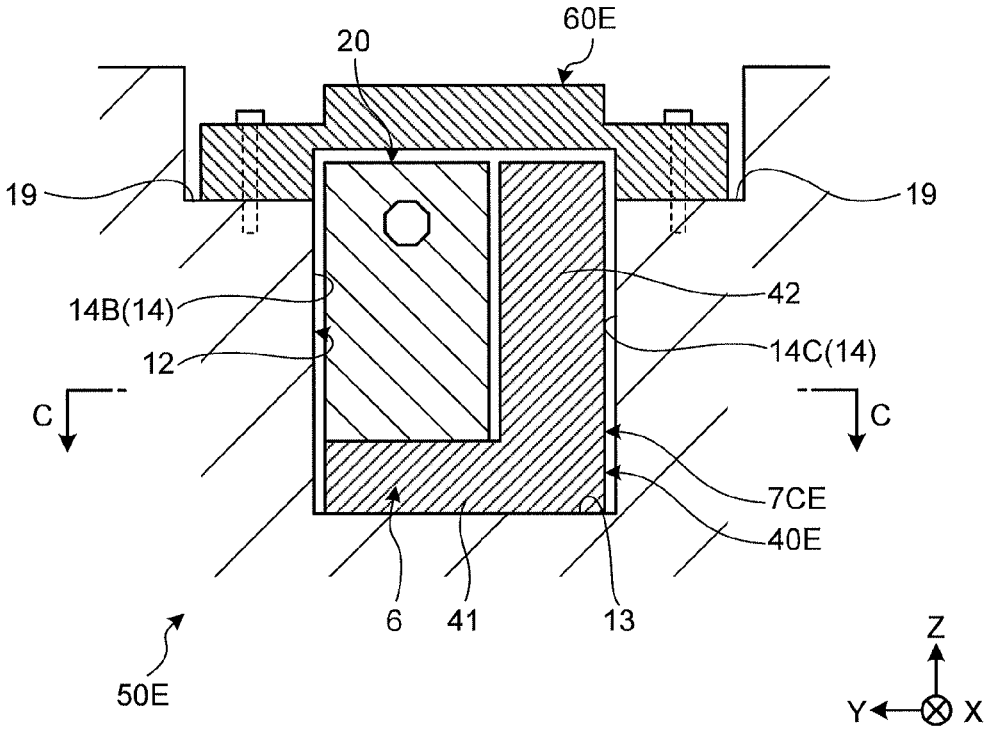
FIG. 22 is a diagram illustrating an example of the support device according to the fifth embodiment.
Figure 23:
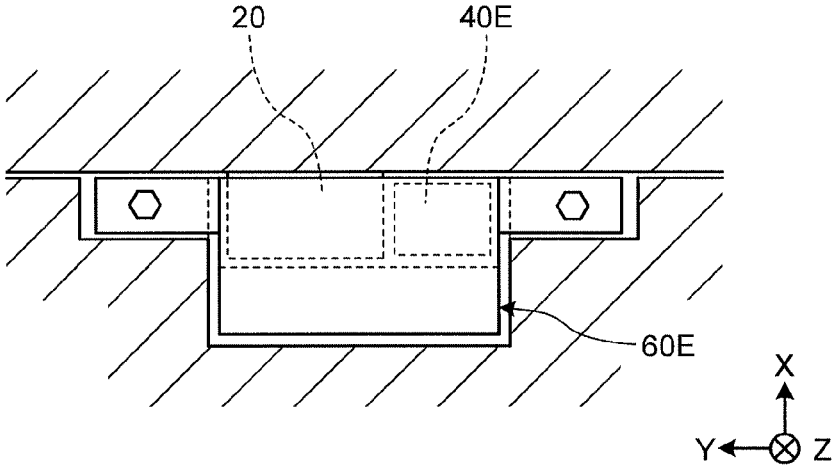
FIG. 23 is a diagram illustrating an example of the support device according to the fifth embodiment.
Figure 24:
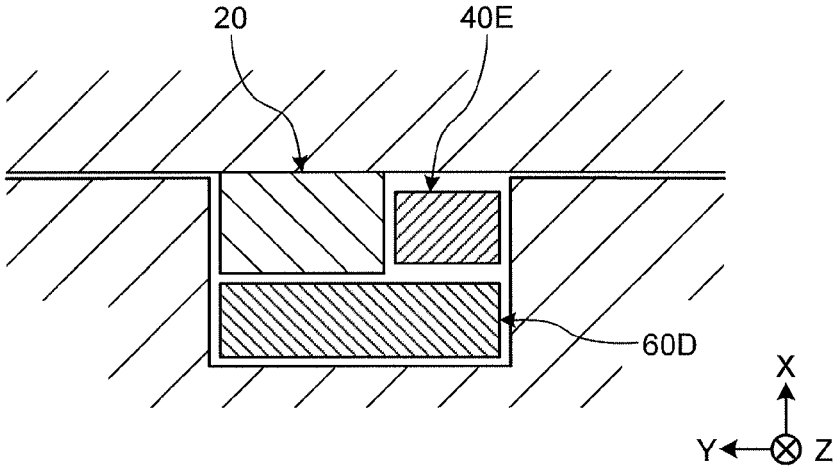
FIG. 24 is a sectional view illustrating an example of the support device according to the fifth embodiment.

FIGS. 21, 22, 23, and 24 are diagrams illustrating an example of a support device 5E according to the present embodiment. FIG. 21 is a sectional view of the support device 5E. FIG. 22 corresponds to a B-B arrow view of FIG. 21. FIG. 22 is a diagram of the support device 5E as viewed from above. FIG. 24 corresponds to a C-C arrow view of FIG. 22.

The support device 5E includes a support member 20 having at least a part fixed to a lower half portion 10B of a blade ring 10, an adjustment member 40E that adjusts the position of the support member 20, and a holding member 60E that holds the support member 20 and the adjustment member 40E.

In the present embodiment, one adjustment member 40E is arranged for one support member 20. A handle portion 42 of the adjustment member 40E is arranged in a space 7CE at the other side (−Y side) of a main body portion 21 in an axial direction parallel to a rotational axis AX of a rotor 2 in a state where an adjustment unit 41 is arranged in a gap 6.

In the present embodiment, the holding member 60E includes a spacer portion 62A arranged in a space 7A. The spacer portion 62 is not arranged in a space 7B and a space 7C.

In the present embodiment, in replacement of an adjustment member 70E, the adjustment unit 41 passes through the space 7A. In the present embodiment, the adjustment member 40E is moved in the radial direction (radius direction) such that one state where the adjustment unit 41 is arranged in the gap 6 is changed to the other state where the adjustment unit 41 is arranged in the space 7A outside the gap 6.

As described above, the space 7 for allowing the adjustment member 40E to pass through may be arranged outside the main body portion 21 in the radial direction. In replacement of the adjustment member 40E, the adjustment member 40E may be moved in the radial direction. As described in the present embodiment, the number of the adjustment members 40E may be one.

Note that, in the above-described embodiments, the casing 11, the support member 20, the adjustment members 40, and the holding member 60 may be arranged at intervals in consideration of deformation due to heat and the like.

REFERENCE SIGNS LIST

1 Steam turbine
2 Rotor (rotating body)
3 Fixed body
4 Vane
5 Support device
6 Gap
7 Space
10 Blade ring
10A Upper half portion
10B Lower half portion
11 Casing
11A Upper half portion
11B Lower half portion
12 Recessed portion (groove portion)
13 Bottom surface
14 Inner wall surface
15 Recessed portion (hole portion)
16 Upper surface
17 Outer surface
18 Inner surface
19 Support surface
20 Support member (first member)
21 Main body portion
22 Protruding portion
23 Lower surface
24 Upper surface
25 Side surface
40 Adjustment member (second member)
41 Adjustment unit
42 Handle portion
43 Liner
44 Portion
45 Plate
46 Bolt member
47 Upper surface
48 Lower surface
60 Holding member (third member)
61 Fixed portion
62 Spacer portion
63 Adjustment unit
64 Bolt member
65 Liner
66 Portion
67 Plate
68 Bolt member
69 Upper surface
70 Lower surface
100 Frame
AX Rotational axis
H1 Thickness
H2 Thickness

The invention claimed is:

1. A support device for supporting an inner member of a fixed body, the fixed body including the inner member and an outer member, the inner member arranged in a vicinity of an outside of a rotating body and divided into an upper half portion and a lower half portion in a vertical direction, and the outer member arranged, at least partially, in a vicinity of an outside of the inner member and divided into an upper half portion and a lower half portion in the vertical direction, the support device comprising:

a first member having a main body portion arranged in a recessed portion provided in the outer member, and adapted to support the inner member;

a second member including a handle portion arranged in a space between a side surface of the main body portion and an inner wall surface of the recessed portion, the inner wall surface positioned, at least partially, in a vicinity of the side surface, and a first adjustment unit movable through the space and arranged in a gap between a vertically lower surface of the main body portion and a bottom surface of the recessed portion, the bottom surface positioned below the vertically lower surface in the vertical direction, the second member adapted to adjust a position of the first member; and a third member including a fixed portion detachably fixed to the outer member, a spacer portion arranged in the space in a state where the fixed portion is fixed to the outer member, and a second adjustment unit arranged above the main body portion in the vertical direction.

2. The support device according to claim 1, wherein the first adjustment unit includes a detachable lower liner positioned below the vertically lower surface of the main body portion in the vertical direction.

3. The support device according to claim 1, wherein the space is formed in an axial direction along a rotational axis of the rotating body.

4. The support device according to claim 1, wherein the space includes a first partial space where the handle portion is arranged, and a second partial space where the first adjustment unit passes through.

5. The support device according to claim 4, wherein one of the first partial space and the second partial space is provided in an axial direction along a rotational axis of the rotating body with respect to the main body portion, and the other of the first partial space and the second partial space is provided in a radial direction with respect to the rotational axis with respect to the main body portion.

6. The support device according to claim 1, wherein the second adjustment unit includes a detachable upper liner positioned above the upper surface of the main body portion in the vertical direction.

7. The support device according to claim 1, wherein the handle portion and at least a part of the first adjustment unit are integrally formed.

8. A turbine comprising:

the support device according to claim 1;

a blade ring supported by the support device; and a casing arranged in a vicinity of an outside of the blade ring.

9. A support method for supporting an inner member of a fixed body, the fixed body including the inner member and an outer member, the inner member arranged in a vicinity of an outside of a rotating body and divided into an upper half portion and a lower half portion in a vertical direction, and the outer member arranged, at least partially, in a vicinity of an outside of the inner member and divided into an upper half portion and a lower half portion in the vertical direction, the support method using a support device including a first member including a main body portion arranged in a recessed portion provided in the outer member and adapted to support the inner member, a second member including a handle portion arranged in a space between a side surface of the main body portion and an inner wall surface of the recessed portion, the inner wall surface being positioned, at least partially, in a vicinity of the side surface, and a first adjustment unit arranged in a gap between a vertically lower surface of the main body portion, the vertically lower surface being positioned below in the vertical direction, and a bottom surface of the recessed portion, the bottom surface being positioned below the vertically lower surface in the vertical direction, and able to pass through the space, the second member being adapted to adjust a position of the first member, and a third member including a fixed portion detachably fixed to the outer member, a spacer portion arranged in the space in a state where the fixed portion is fixed to the outer member, and a second adjustment unit arranged above the main body portion in the vertical direction, the support method comprising:

operating the handle portion arranged in the space to move the second member such that the first adjustment unit arranged in the gap is moved outside the gap;

moving the second member such that the first adjustment unit moved outside the gap passes through the space, and detaching the second member from the recessed portion;

adjusting a thickness of the first adjustment unit;

moving the second member so as to be arranged in the gap after the first adjustment unit with an adjusted thickness passes through the space, and attaching the second member to the recessed portion;

supporting the inner member with the first adjustment unit arranged in the gap and the first member;

cancelling fixation of the third member, and detaching the third member from the outer member; and moving the second member such that the first adjustment unit passes through the space where the spacer portion has been arranged.

10. The support method according to claim 9, wherein the handle portion is arranged outside the main body portion in a radial direction with respect to a rotational axis of the rotating body in a state where the first adjustment unit is arranged in the gap.

* * * * *